US011066720B2

(12) United States Patent
Fujii et al.

(10) Patent No.: US 11,066,720 B2
(45) Date of Patent: Jul. 20, 2021

(54) HOT-ROLLED STEEL SHEET AND MANUFACTURING METHOD THEREOF, AND MANUFACTURING METHOD OF COLD-ROLLED STEEL SHEET

(71) Applicant: NIPPON STEEL & SUMITOMO METAL CORPORATION, Tokyo (JP)

(72) Inventors: Takashi Fujii, Tokyo (JP); Hiromitsu Date, Tokyo (JP); Akira Taniyama, Tokyo (JP); Takumi Nishimoto, Tokyo (JP); Kenichiro Tadokoro, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 515 days.

(21) Appl. No.: 15/540,855

(22) PCT Filed: Mar. 22, 2016

(86) PCT No.: PCT/JP2016/059027
§ 371 (c)(1),
(2) Date: Jun. 29, 2017

(87) PCT Pub. No.: WO2016/152870
PCT Pub. Date: Sep. 29, 2016

(65) Prior Publication Data

US 2017/0369964 A1 Dec. 28, 2017

(30) Foreign Application Priority Data

Mar. 23, 2015 (JP) ..... JP2015-059645

(51) Int. Cl.
*C21D 9/46* (2006.01)
*C22C 38/00* (2006.01)
(Continued)

(52) U.S. Cl.
CPC ..... *C21D 9/46* (2013.01); *B21B 1/22* (2013.01); *B21B 3/00* (2013.01); *C21D 6/001* (2013.01);
(Continued)

(58) Field of Classification Search
None
See application file for complete search history.

(56) References Cited

U.S. PATENT DOCUMENTS

2005/0139293 A1 6/2005 Nomura et al.
2013/0248055 A1 9/2013 Bocharova et al.
(Continued)

FOREIGN PATENT DOCUMENTS

CA 2915776 A1 1/2015
CA 2915776 C * 8/2018 ..... B22D 11/001
(Continued)

OTHER PUBLICATIONS

JP-2009287094-A Espacenet English machine translation (Year: 2009) (Year: 2009).*
(Continued)

*Primary Examiner* — Alexandra M Moore
*Assistant Examiner* — Adil A. Siddiqui
(74) *Attorney, Agent, or Firm* — Birch, Stewart, Kolasch & Birch, LLP

(57) ABSTRACT

A Si/Mn ratio of steel material components of a base material is not less than 0.27 nor more than 0.90 in mass ratio, an internal oxide layer having a thickness of not less than 1 μm nor more than 30 μm is provided right below an oxide scale of a steel sheet surface layer portion, and regarding the internal oxide layer, an internal oxide in a crystal grain of the internal oxide layer is an oxide containing Si and having a thickness of not less than 10 nm nor more than 200 nm in a crystal grain in a range of greater than
(Continued)

0% and 30% or less of a thickness of the internal oxide layer from an interface between the internal oxide layer and base iron toward a direction of the surface layer oxide scale, one or more branches of the internal oxide exist in a cross section of 1 μm×1 μm square, and in any crystal grain boundary having a length of 1 μm, one or more of the internal oxides in the crystal grain are connected to an internal oxide of the crystal grain boundary to form a net-like structure.

8 Claims, 4 Drawing Sheets

(51) Int. Cl.

| | |
|---|---|
| ***C22C 38/58*** | (2006.01) |
| ***C21D 8/04*** | (2006.01) |
| ***B21B 1/22*** | (2006.01) |
| ***B21B 3/00*** | (2006.01) |
| ***C21D 6/00*** | (2006.01) |
| ***C21D 8/02*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/14*** | (2006.01) |
| ***C23G 1/08*** | (2006.01) |

(52) U.S. Cl.

CPC ..... *C21D 6/005* (2013.01); *C21D 6/008* (2013.01); *C21D 8/0205* (2013.01); *C21D 8/0226* (2013.01); *C21D 8/0263* (2013.01); *C21D 8/0463* (2013.01); *C22C 38/00* (2013.01); *C22C 38/002* (2013.01); *C22C 38/02* (2013.01); *C22C 38/04* (2013.01); *C22C 38/06* (2013.01); *C22C 38/08* (2013.01); *C22C 38/14* (2013.01); *C22C 38/58* (2013.01); *C23G 1/08* (2013.01); *B21B 2001/225* (2013.01)

(56) References Cited

U.S. PATENT DOCUMENTS

| | | | |
|---|---|---|---|
| 2014/0242414 | A1 | 8/2014 | Minami et al. |
| 2014/0314616 | A1 | 10/2014 | Miyata et al. |
| 2014/0342184 | A1 | 11/2014 | Takagi et al. |
| 2016/0102379 | A1 | 4/2016 | Makimizu et al. |

FOREIGN PATENT DOCUMENTS

| | | | | |
|---|---|---|---|---|
| JP | 63-11083 | B2 | | 3/1988 |
| JP | 2-50908 | A | | 2/1990 |
| JP | 9-256066 | A | | 9/1997 |
| JP | 2003-306745 | A | | 10/2003 |
| JP | 3934604 | B2 | | 6/2007 |
| JP | 2009-287094 | A | | 12/2009 |
| JP | 2009287094 | A | * | 12/2009 |
| JP | 2011-231391 | A | | 11/2011 |
| JP | 2011231391 | A | * | 11/2011 |
| JP | 2012-36483 | A | | 2/2012 |
| JP | 5267638 | B2 | | 8/2013 |
| JP | 5271981 | B2 | | 8/2013 |
| JP | 5315795 | B2 | | 10/2013 |
| JP | 2013-237101 | A | | 11/2013 |
| JP | 2013-237924 | A | | 11/2013 |
| JP | 2013237924 | A | * | 11/2013 |
| JP | 2014-227562 | A | | 12/2014 |
| TW | 201313913 | A1 | | 4/2013 |

OTHER PUBLICATIONS

JP-2013237924-A Espacenet English Machine Translation (Year: 2013).*

English translation of the International Preliminary Report on Patentability and Written Opinion of the International Searching Authority (Forms PCT/IB/338, PCT/IB/373 and PCT/ISA/237) for International Application No. PCT/JP2016/059027, dated Oct. 5, 2017.

Chinese Office Action and Search Report, dated Jun. 29, 2018, for corresponding Chinese Application No. 201680015690.5, with an English translation of the Office Action.

Zhou et al, "Unique characteristics of kinetics and morphology of high-temperature oxidation for low-carbon high-Si high-Mn steel", Heat Treatment of Metals, vol. 37, No. 7, Jul. 2012, 9 pages, with partial translation.

Extended European Search Report, dated Sep. 7, 2018, for corresponding European Application No. 16768773.0.

International Search Report for PCT/JP2016/059027 dated May 17, 2016.

Office Action for TW 105109012 dated Dec. 9, 2016.

Written Opinion of the International Searching Authority for PCT/JP2016/059027 (PCT/ISA/237) dated May 17, 2016.

* cited by examiner

HOT-ROLLED STEEL SHEET AND MANUFACTURING METHOD THEREOF, AND MANUFACTURING METHOD OF COLD-ROLLED STEEL SHEET

TECHNICAL FIELD

The present invention relates to a steel sheet having high contents of Si and Mn, and relates to a hot-rolled steel sheet capable of reducing a pickling time of a steel sheet after being subjected to hot rolling and then coiling and a manufacturing method thereof, and a manufacturing method of a cold-rolled steel sheet obtained by performing cold rolling on the hot-rolled steel sheet.

BACKGROUND ART

A high-strength steel sheet used as a framework member for automobile generally contains a large amount of Si and Mn, in order to realize both of high strength and high ductility. It is known that, when hot rolling is performed on such a steel material containing a large amount of Si and Mn and then the material is coiled in a coil shape at approximately 550° C. or more, a Si-based oxide is generated at a grain boundary of crystal containing metallic iron as a main parent phase and in a crystal grain, in base iron right below an oxide scale of a steel sheet surface layer portion. The generation of the oxide is so-called internal oxidation, and it normally occurs in a thickness of several μm to several tens μm. A layer containing the oxide generated by the internal oxidation (referred to as "internal oxide layer", hereinafter) has a parent phase whose main component is metallic iron, so that picklability thereof is poor. For this reason, it is not possible to completely remove the internal oxide layer by a pickling time equal to that for a general hot-rolled steel sheet having only an oxide scale, and a pickling time which is several times as long as the above pickling time is required, resulting in that productivity of the hot-rolled steel sheet significantly lowers. Further, it cold rolling is performed without completely removing the internal oxide layer, a crack occurs due to peeling of the remaining internal oxide layer, which causes deterioration of conversion property or occurrence of pickup on a surface of hearth roll during annealing.

The internal oxidation occurs when activities of oxidizable elements are high and the elements exist under a specific oxygen potential such as a case where certain amounts of Si and Mn being the oxidizable elements are contained in a steel material. A high-strength steel sheet such as one causing the internal oxidation normally contains approximately 0.5 mass % or more of Si and approximately 0.5 mass % or more of Mn. Further, an oxide scale of a steel sheet surface layer portion generated in hot rolling is considered to be an oxygen source for the internal oxidation. Further, generally, a temperature becomes a driving force of the internal oxidation, so that when a coiling temperature is high, increase in thickness of the internal oxide layer is caused more easily. Accordingly, the internal oxidation does not occur when the contents of the oxidizable elements in the steel material are small, when the oxide scale which becomes the oxygen source does not exist in the steel sheet surface layer, or when the temperature at the time of coiling is low. Note that a Si oxide layer containing Fe and Mn is sometimes formed on an interface between the oxide scale and the internal oxide layer, and the Si oxide layer can be treated as a part of the oxide scale.

However, it is essential for the high-strength steel sheet to contain C, Si, and Mn, in order to secure the strength and the ductility. Further, since a phase transformation from the hot rolling to the coiling is slow due to a high content of alloy, when coiling is performed at a low temperature, a large amount of martensite and retained austenite are generated, resulting in that strength of a hot-rolled original sheet increases, and it is not possible to avoid occurrence of fracture at the time of cold rolling. For this reason, there is a need to perform coiling at a high temperature so that a ferrite transformation and a pearlite transformation are made to progress to cause softening, which accompanies the internal oxidation at the same time.

In order to suppress or avoid the internal oxidation, Patent Reference 1, for example, proposes a technique in which a grain boundary oxide layer generated right below a scale layer of a hot-rolled steel sheet and containing a Si and Mn-based oxide 21 of about 5 μm or more in a crystal grain boundary 22, and an internal oxide layer 20 in which the Si and Mn-based oxide 21 is precipitated in a granular form in a metallic parent phase 23, as illustrated in FIG. 2, are appropriately removed through pickling after hot rolling, which enables to effectively prevent defect of conversion treatment property of a high-strength cold-rolled steel sheet. In this technique, a required pickling time is derived from a thickness of the grain boundary oxide layer and a dissolving time of an oxide scale layer, and, for example, in a case of a hot-rolled steel sheet which requires 45 seconds for dissolving the oxide scale layer, it is set that pickling has to be performed for 90 seconds or more when the grain boundary oxide layer has the thickness of 5 μm, the pickling has to be performed for 135 seconds or more when the layer has the thickness of 10 μm, the pickling has to be performed for 180 seconds or more when the layer has the thickness of 15 μm, and the pickling has to be performed for 225 seconds or more when the layer has the thickness of 20 μm. However, since this technique requires a pickling time which is several times or more as long as a pickling time for a general hot-rolled steel sheet having only an oxide scale, so that it is not possible to avoid significant reduction in productivity.

Patent Reference 2 proposes a technique regarding, not a high-strength steel sheet with high Si content and high Mn content, but a high nickel steel and a high nickel-chromium steel each containing 5 mass % or more of nickel, in which an antioxidant is coated on a surface of a steel billet of each of the steels, a part or all of the surface is covered by a steel sheet to prevent grain boundary oxidation during heating, to thereby prevent an edge crack from occurring during hot rolling. However, in this technique, it is not possible to expect an effect of suppressing internal oxidation including the grain boundary oxidation, in a temperature range from 500 to 800° C. such as a temperature of a steel sheet after being subjected to hot rolling and then coiling. Further, to coat the antioxidant on the entire surface of the steel sheet, is not realistic in terms of addition of step and a cost of the antioxidant.

Patent Reference 3 discloses a technique in which a hot-rolled Si-containing steel sheet is subjected to heat treatment at 700° C. or more for 5 minutes to 60 minutes in a nitrogen atmosphere in which $O_2$ is controlled to less than 1 vol %. It is described that when such heat treatment is performed, supply of oxygen to a surface of the steel sheet is suppressed to suppress growth of an oxide scale, and further, by causing sufficient diffusion of oxygen from the oxide scale to base iron, a depleted layer of Si and Mn is formed in a grain boundary oxidized portion formed in the base iron right below the oxide scale of a steel sheet surface layer portion. However, there is a need to retain a steel material after being subjected to hot rolling and before being coiled, under a high temperature of 700° C. or more, and to control an atmosphere, which is not realistic in terms of facility and productivity.

Further, Patent References 4 to 6 disclose a shape and the like of an internal oxide. However, a task of each of the inventions disclosed in Patent References 4 to 6 is not the improvement of picklability.

As described above, in the conventional techniques, the components and the manufacturing process in pursuit of improvement of strength and workability are taken into consideration, and the picklability is not taken into consideration almost at all. Meanwhile, it is known that pickling of an internal oxide layer is difficult to be performed, and further, there is necessity of removing the internal oxide layer. However, a countermeasure which has been taken is to try to suppress the internal oxidation by increasing a pickling time, or adding a manufacturing step in a manner that the steel material is coated with the antioxidant and covered in order to obtain an effect of prevention of internal oxidation or the atmosphere gas is controlled, without changing a steel material component and the manufacturing process. However, even if the internal oxidation is suppressed to reduce a thickness of the internal oxide layer, the fact that the internal oxide layer having metallic iron as a parent phase is hardly dissolved, is not changed basically, so that it is not possible to say that the techniques are good enough as techniques which significantly improve the picklability.

CITATION LIST

Patent Reference

Patent Reference 1: Japanese Laid-open Patent Publication No. 2013-237924

Patent Reference 2: Japanese Examined Patent Application Publication No. 63-11083

Patent Reference 3: Japanese Patent No. 5271981

Patent Reference 4: Japanese Patent No. 5315795

Patent Reference 5: Japanese Patent No. 3934604

Patent Reference 6: Japanese Patent No. 5267638

Patent Reference 7: Japanese Laid-open Patent Publication No. 2013-237101

Patent Reference 8: Japanese Laid-open Patent Publication No. 02-50908

Patent Reference 9: Japanese Laid-open Patent Publication No. 2014-227562

SUMMARY OF INVENTION

Technical Problem

In view of the above-described problems, the present invention has an object to provide a hot-rolled steel sheet having an internal oxide layer structure excellent in acid dissolubility and a manufacturing method thereof, and a manufacturing method of a cold-rolled steel sheet.

Solution to Problem

The present inventors made detailed studies on manufacturing conditions regarding a method of significantly improving picklability while satisfying restrictions on a manufacturing process, without increasing a cost and without largely reducing productivity. As a result of this, they found out that when steel material components and control of heat quantity after performing coiling satisfy specific conditions, it becomes possible to form an internal oxide layer structure which is easily pickled, while satisfying properties required for a high-strength steel sheet.

Specifically, the present inventors found out that by performing control of a Si/Mn ratio as steel sheet components and temperature control after performing hot rolling and coiling, it is possible to make an internal oxide layer structure with high acid dissolubility. As described above, they found out that it is possible to increase the picklability of the internal oxide layer and to significantly reduce the pickling time, based on an approach which is totally different from that of the conventional technique aiming at the improvement of picklability by suppressing the internal oxidation. Through the above-described means, the present inventors solved the problems, which have not been solved by a person skilled in the art, and arrived at the present invention.

The gist of the present invention is as follows.

(1) A hot-rolled steel sheet is characterized in that it contains:

C: 0.05 mass % to 0.45 massa;

Si: 0.5 mass % to 3.0 mass %;

Mn: 0.50 mass % to 3.60 mass % or less;

P: 0.030 mass % or less;

S: 0.010 mass % or less;

Al: 0 mass % to 1.5 mass %;

N: 0.010 mass % or less;

O: 0.010 mass % or less;

Ti: 0 mass % to 0.150 mass %;

Nb: 0 mass % to 0.150 mass %;

V: 0 mass % to 0.150 mass %;

B: 0 mass % to 0.010 mass %;

Mo: 0 mass % to 1.00 mass %;

W: 0 mass % to 1.00 mass %;

Cr: 0 mass % to 2.00 mass %;

Ni: 0 mass % to 2.00 mass %;

Cu: 0 mass % to 2.00 mass %;

a total of one kind or two kinds or more selected from a group consisting of Ca, Ce, Mg, Zr, Hf, and REM: 0 mass % to 0.500 mass %; and the balance: iron and impurities, in which:

a Si/Mn ratio of steel material components of a base material of the steel sheet is not less than 0.27 nor more than 0.90 in mass ratio;

an internal oxide layer having a thickness of not less than 1 μm nor more than 30 μm is provided right below an oxide scale of a steel sheet surface layer portion; and an internal oxide in a crystal grain of the internal oxide layer is an oxide containing Si and having a thickness of not less than 10 nm nor more than 200 nm in a crystal grain in a range of greater than 0% and 30% or less of a thickness of the internal oxide layer from an interface between the internal oxide layer and base iron toward a direction of the surface layer oxide scale, one or more branches of the internal oxide exist in a cross section of 1 μm×1 μm square, and in any crystal grain boundary having a length of 1 μm, one or more of the internal oxides are connected to an internal oxide of the crystal grain boundary to form a net-like structure.

(2) The hot-rolled steel sheet described in (1) is characterized in that the Si/Mn ratio of the steel material components of the base material is 0.70 or loss in mass ratio.

(3) The hot-rolled steel sheet described in (1) or (2) is characterized in that, in the internal oxide layer, an oxide $(Fe_x, Mn_{1-x})_2SiO_4$ ($0 \leq x < 1$) whose x value decreases toward a center of the steel sheet, and an amorphous $SiO_2$ exist.

(4) The hot-rolled steel sheet described in any one of (1) to (3) is characterized in that, in the internal oxide layer, the oxide containing Si and having the net-like structure exists in a range of greater than 0% and 50% or less of the thickness of the internal oxide layer from the interface between the internal oxide layer and the base iron toward the direction of the surface layer oxide scale.

(5) A manufacturing method of a hot-rolled steel sheet is characterized in that it includes the steps of:

heating and performing hot rolling on a slab containing: C: 0.05 mass % to 0.45 mass %; Si: 0.5 mass % to 3.0 mass %; Mn: 0.50 mass % to 3.60 mass % or less; P: 0.030 mass % or less; S: 0.010 mass % or less; Al: 0 mass % to 1.5 mass %; N: 0.010 mass % or less; O: 0.010 mass % or less; Ti: 0 mass % to 0.150 mass %; Nb: 0 mass % to 0.150 mass %; V: 0 mass % to 0.150 mass %; B: 0 mass % to 0.010 mass %; Mo: 0 mass % to 1.00 mass %; W: 0 mass % to 1.00 mass %; Cr: 0 mass % to 2.00 mass %; Ni: 0 mass % to 2.00 mass %; Cu: 0 mass % to 2.00 mass %; a total of one kind or two kinds or more selected from a group consisting of Ca, Ce, Mg, Zr, Hf, and REM: 0 mass % to 0.500 mass %; and the balance: iron and impurities, and having a Si/Mn ratio of not less than 0.27 nor more than 0.90 in mass ratio;

coiling the hot-rolled steel sheet at not less than 550° C. nor more than 800° C.; and retaining the coiled material in a cooling process in a range of not less than 400° C. nor more than 500° C. for not less than 10 hours nor more than 20 hours to obtain a hot-rolled steel sheet.

(6) A manufacturing method of a cold-rolled steel sheet is characterized in that it includes the steps of:

heating and performing hot rolling on a slab containing: C: 0.05 mass % to 0.45 mass %; Si: 0.5 mass % to 3.0 mass %; Mn: 0.50 mass % to 3.60 mass % or less; P: 0.030 mass % or less; S: 0.010 mass % or less; Al: 0 mass % to 1.5 mass %; N: 0.010 mass % or less; O: 0.010 mass % or less; Ti: 0 mass % to 0.150 mass %; Nb: 0 mass % to 0.150 mass %; V: 0 mass % to 0.150 mass %; B: 0 mass % to 0.010 mass %; Mo: 0 mass % to 1.00 mass %; W: 0 mass % to 1.00 mass %; Cr: 0 mass % to 2.00 mass %; Ni: 0 mass % to 2.00 mass %; Cu: 0 mass % to 2.00 mass %; a total of one kind or two kinds or more selected from a group consisting of Ca, Ce, Mg, Zr, Hf, and REM: 0 mass % to 0.500 mass %; and the balance: iron and impurities, and having a Si/Mn ratio of not less than 0.27 nor more than 0.90 in mass ratio;

coiling the hot-rolled steel sheet at not less than 550° C. nor more than 800° C.;

retaining the coiled material in a cooling process in a range of not less than 400° C. nor more than 500° C. for not less than 10 hours nor more than 20 hours to obtain a hot-roiled steel sheet;

performing pickling on the hot-rolled steel sheet; and performing cold rolling on the pickled hot-rolled steel sheet to obtain a cold-rolled steel sheet.

Advantageous Effects of Invention

According to the present invention, picklability of a hot-rolled steel sheet is improved, a pickling time can be reduced, and productivity can be greatly improved.

DESCRIPTION OF EMBODIMENTS

The present inventors made detailed studies on manufacturing conditions regarding occurrence of internal oxidation in a coiled material. As a result of this, they found out that by performing control of a Si/Mn ratio being a mass ratio of contents of Si and Mn being steel material components, and control of heat quantity after performing coiling, it is possible to make an internal oxide containing Si in an internal oxide layer to be generated connect to a crystal grain boundary in the internal oxide layer to form a net-like structure in a crystal grain. By forming such a structure, significant reduction of a pickling time was realized.

Figure 1:
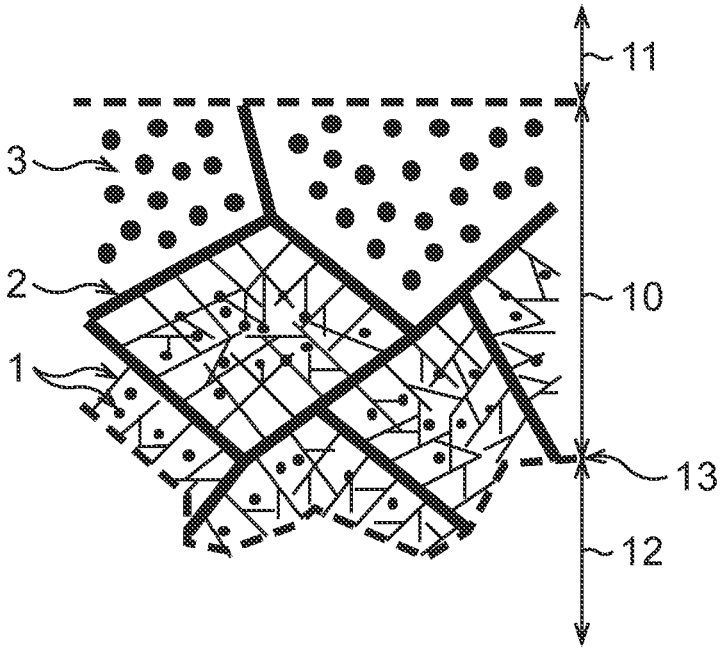
FIG. 1 is an enlarged sectional view of an internal oxide layer and in the vicinity thereof formed in a hot-rolled steel sheet of the present invention.

FIG. 1 is an enlarged sectional view of an internal oxide layer 10 and in the vicinity thereof formed in a hot-rolled steel sheet of the present invention.

An internal oxide 1 forming a net-like structure of the internal oxide layer 10 is an oxide containing Si and having a thickness of not less than 10 nm nor more than 200 nm, and is connected from a crystal grain boundary 2 to the inside of a crystal grain, as illustrated in FIG. 1. Further, the internal oxides 1 respectively and independently have a granular shape, a linear shape, or a branch structure also in the crystal grain to form a continuous net-like shape. Accordingly, an acid solution permeated through the crystal grain boundary between a surface layer oxide scale 11 and the internal oxide layer 10 reaches a lower portion of the internal oxide layer 10 in which the net-like structure is formed, and then the solution reaches the inside of the crystal grain from the crystal grain boundary 2. Further, the acid solution permeates through the inside of the crystal grain from an interface between the internal oxide 1 having the net-like structure and a metallic parent phase 3, as a path through which the metallic parent phase 3 and the internal oxide 1 are dissolved. Hereinafter, the path through which the metallic parent phase 3 and the internal oxide 1 are dissolved, is referred to as a dissolving path.

As described above, when a starting point of dissolution effectively exists in the crystal grain, it is possible to increase the acid dissolubility of even the internal oxide layer which is hardly dissolved since it originally has metallic iron as a parent phase. Further, even if the net-like structure is not generated in the entire area of the internal oxide layer 10, as long as the net-like structure is generated in layers in the vicinity of an interface between the internal oxide layer 10 of a position corresponding to an inward position of the internal oxide layer and base iron 12 (an interface 13 between the internal oxide layer and the base iron), the inward position of the internal oxide layer 10 is dissolved first, so that it also becomes possible to peel and remove the surface layer oxide scale 11 side being an outward position of the internal oxide layer 10 which is left undissolved, together with the crystal grain.

In order to obtain the internal oxide having the net-like structure as described above, the Si/Mn ratio of the steel material components is set to not less than 0.27 nor more than 0.90. Accordingly, there is a need to generate an oxide represented by a chemical composition of $(Fe_x, Mn_{1-x})_2SiO_4$ ($0 \leq x < 1$) and an amorphous $SiO_2$. Further, it can be considered that the oxide represented by the chemical composition of $(Fe_x, Mn_{1-x})_2SiO_4$ ($0 \leq x < 1$), becomes a gelled Si oxide by being eluted as $Fe^{2+}$ and $Mn^{2+}$ ions in an acid solution. As described above, to provide an acid-dissoluble oxide is also effective for forming a dissolving path at an interface between the internal oxide having the net-like structure (net-like oxide) and the metallic parent phase 3.

However, when the internal oxide layer is generated only in a part of the inside of the crystal grain, the dissolubility of a generation part of the internal oxide is only increased, and it is not possible to increase the picklability of the entire internal oxide layer. Accordingly, in addition to the control of the Si/Mn ratio, retention is performed for not less than 10 hours nor more than 20 hours in a range of not less than 400° C. nor more than 500° C., which is a temperature range lower by 50° C. to 100° C. from a temperature at which the internal oxidation occurs. Consequently, the net-like structure is formed in a manner that the internal oxides are dispersed, not only in the crystal grain boundary and the vicinity of the crystal grain boundary but also in substantially the entire area in the crystal grain, while preventing increase in film thickness, resulting in that the internal oxide layer structure excellent in picklability is obtained.

Figure 3A:
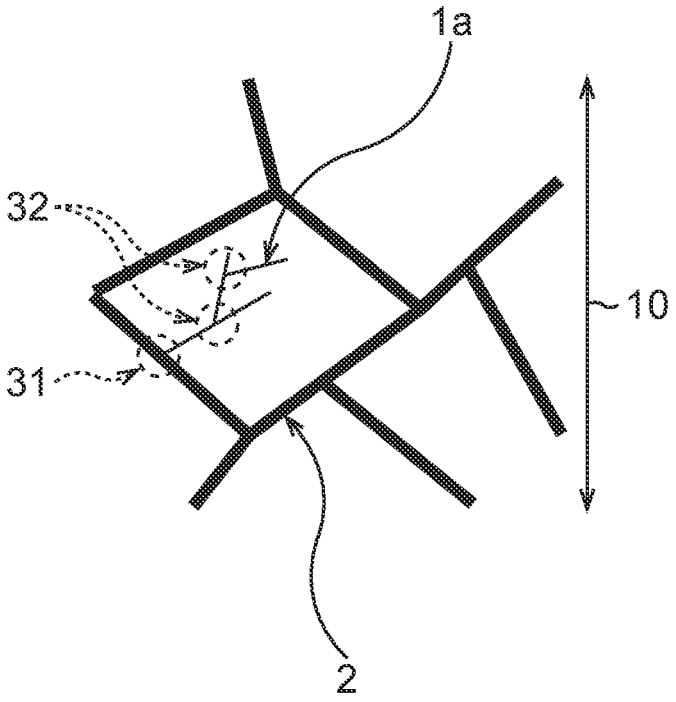
FIG. 3A is a schematic diagram illustrating a connection state between an internal oxide in a crystal grain and an oxide of a crystal grain boundary, forming a net-like structure in the present invention.

FIG. 3A illustrates a connection state between an internal oxide in a crystal grain and an internal oxide of a crystal grain boundary, forming the net-like structure. The net-like structure is a structure in which an internal oxide 1*a* in the crystal grain is branched at branching portions 32 in the crystal grain, and a part of the internal oxide in the crystal grain is connected to an internal oxide of the crystal grain boundary 2 at a connecting portion 31, as illustrated in FIG. 3A.

Figure 3B:
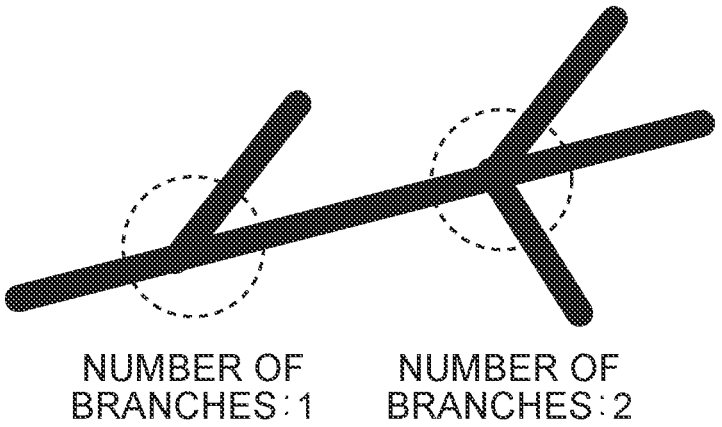
FIG. 3B is a diagram for explaining how to count a number of branches in the net-like structure in the present invention.

FIG. 3B is a diagram for explaining how to count a number of branches in the net-like structure. The number of branches in the net-like structure is set to a number of branching (number of branches derived from an original branch) in a continuous body of oxide which is seen when observing a cross section using a transmission electron microscope (TEM), a scanning electron microscope (SEM), or the like (at 5000 to 80000 magnifications).

Hereinafter, the present invention will be described in detail.

<Si/Mn Ratio: Not Less Than 0.27 nor More Than 0.90>

The Si content and the Mn content in the steel sheet components of the base material are limited to fall within specific ranges in order to realize exhibition of properties such as strength and ductility which are required as a high-strength steel sheet. Meanwhile, the Si/Mn ratio becomes an important factor for determining a composition of oxide to be generated, in a process during which a hot-rolled coiled material is subjected to internal oxidation. Generally, in a high-strength steel sheet with high contents of Si and Mn, it can be considered that $Fe_2SiO_4$, $Mn_2SiO_4$, $FeSiO_3$, $MnSiO_3$, and $SiO_2$, as Si-based oxides, can be generated as internal oxides. Meanwhile, the contents of Si and Mn and an oxygen potential determine the composition and an amount of oxide to be generated. Al, Ti, Cr, and the like are also elements which are more easily oxidized than iron and thus may become internal oxidizable elements, but, they do not exert influence almost at all on the structure and the composition of the internal oxide layer within a range of contents of the steel sheet targeted by the present invention. In a hot-rolled coiled material, an oxide scale of a steel sheet surface layer portion normally becomes an oxygen source. Further, $Fe_2SiO_4$ and $Mn_2SiO_4$ exhibit complete solid solubility in each other, and $FeSiO_3$ and $MnSiO_3$ exhibit complete solid solubility in each other, so that it can be considered that oxides having compositions represented by $(Fe_x, Mn_{1-x})_2SiO_4$ and $(Fe_x, Mn_{1-x})SiO_3$ are also generated within a range of $0 \leq x \leq 1$.

The present inventors found out that in the composition of the Si-based internal oxide to be generated, the control of Si/Mn ratio is important. When the Si/Mn ratio is high, $Fe_2SiO_4$ and $SiO_2$ are generated, but, $Mn_2SiO_4$ is not generated. Although the reason thereof has not been clear, it is assumed that this is because $SiO_2$ which is generated even under a lower oxygen potential, and $Fe_2SiO_4$ being an oxide between Fe, FeO being maximum contained elements and $SiO_2$ are preferentially generated.

Further, based on the studies conducted by the present inventors, it was found out that the Si/Mn ratio of the base material has to be 0.90 or less, as a condition of the steel material components with which the oxide containing Si and having the net-like structure with high acid dissolubility is generated. When the Si/Mn ratio exceeds 0.90, it is difficult to generate the $(Fe_x, Mn_{1-x})_2SiO_4$ ($0 \leq x < 1$) containing Mn, and it is not possible to increase the acid dissolubility of the internal oxide layer. The Si/Mn ratio is more preferably 0.70 or less. If the Si/Mn ratio is 0.70 or less, a formation region of the $(Fe_x, Mn_{1-x})_2SiO_4$ with high Mn proportion increases in a range of $0 \leq x < 1$, resulting in that the acid dissolubility of the entire internal oxide layer can be further increased. Further, a lower limit of the Si/Mn ratio of the base material is 0.27. This corresponds to a Si/Mn ratio capable of forming both of the $(Fe_x, Mn_{1-x})_2SiO_4$ ($0 \leq x < 1$) exhibiting properties as a high-strength steel sheet and having a high Mn proportion of a net-like oxide and the amorphous $SiO_2$. When the Mn content in the steel material exceeds 3.60 mass % and the Si/Mn ratio is less than 0.27, weld defect and slab cracking in a manufacturing line of a high-strength steel sheet, defect during welding as a member for automobile, and the like occur, resulting in that the properties required as a high-strength steel sheet are not satisfied.

Note that there exist inventions, other than the present invention, which specify a Si/Mn ratio of a steel material. For example, Patent Reference 5 has an object to suppress generation of an oxide mainly composed of Si, on a steel sheet, for increasing adhesiveness of a coating film of a cold-rolled steel sheet, although it is not made for the purpose of providing a hot-rolled steel sheet and a cold-rolled steel sheet excellent in picklability. Further, Patent Reference 6 has an object to make Si to be subjected to internal oxidation as a composite oxide without being generated on a surface of a steel sheet during an annealing step. Both of Patent References 5 and 6 specify the Si/Mn ratio. However, as described above, the internal oxide layer having the oxide with the net-like structure of the present invention cannot be realized only by the control of the Si/Mn ratio, and can be realized only after a heat quantity is applied in a predetermined temperature range and for a predetermined period of time after performing coiling of the hot-rolled steel sheet. Accordingly, since each of the aforementioned Patent References 5 and 6 does not perform the control of heat quantity as in the present invention, an oxide structure thereof is different from the oxide structure such that the oxide is connected to the crystal grain boundary to be generated in the crystal grain and generated in a net-like shape also in the crystal grain.

<Net-Like Oxide>

The net-like structure containing the oxide represented by the chemical composition of $(Fe_x, Mn_{1-x})_2SiO_4$ ($0 \leq x < 1$) and the amorphous $SiO_2$ generated in the internal oxide layer of the present invention, is important for forming the dissolving path which becomes the starting point of acid dissolution in the crystal grain of the internal oxide layer. Although the reason why the $(Fe_x, Mn_{1-x})_2SiO_4$ ($0 \leq x < 1$) and the amorphous $SiO_2$ form the net-like structure, is not clear, it can be considered that a diffusion path of elements associated with the internal oxidation exerts influence. Specifically, except for iron being a main component of the metallic parent phase, oxygen is diffused from the oxide scale, and Si and Mn are diffused into the internal oxide layer through the crystal grain boundary while forming a depleted layer at the vicinity of the crystal grain boundary and on the interface between the internal oxide layer and the base iron. Accordingly, it can be assumed that the net-like structure is formed since the $(Fe_x, Mn_{1-x})_2SiO_4$ ($0 \leq x < 1$) and the amorphous $SiO_2$ easily grow from the crystal grain boundary, which is set as a starting point, to the inside of the crystal grain in a continuous manner. If the Si/Mn ratio is low, the $(Fe_x, Mn_{1-x})_2SiO_4$ ($0 \leq x < 1$) with higher Mn proportion is generated. A distribution of oxygen potential in the internal oxide layer becomes lower as a position in a sheet thickness direction becomes inward, and thus the x value decreases and the proportion of Mn increases as the position becomes inward. As the $(Fe_x, Mn_{1-x})_2SiO_4$ ($0 \leq x < 1$) with high Mn proportion can be generated more, it is possible to enlarge an easily dissoluble area in the sheet thickness direction.

Figure 2:
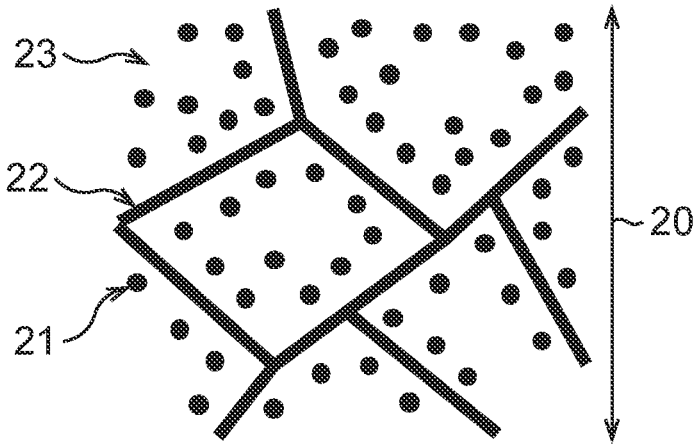
FIG. 2 is a schematic diagram of an internal oxide layer disclosed in Patent Reference 1.

Note that it is not possible to significantly improve the picklability of the internal oxide layer having a thickness of several μm to several tens μm, unless the $(Fe_x, Mn_{1-x})_2SiO_4$ ($0 \leq x < 1$) and the amorphous $SiO_2$ are generated in substantially the entire area in the crystal grain. Normally, when the internal oxide layer is pickled, the crystal grain boundary is first dissolved, as described also in the aforementioned Patent Reference 1, in which in the crystal grain, the parent phase is metallic iron, and the pickling solution contains a pickling inhibitor (inhibitor) for the purpose of suppressing over-dissolution of base iron, so that a speed of dissolution is slow, and it can be considered that how to increase the dissolubility in the crystal grain under the presence of pickling inhibitor becomes a key. Further, as illustrated in FIG. 2, a shape of the internal oxide formed in the crystal grain often has a granular shape, so that each internal oxide is independent and a dissolving path from the crystal grain boundary to the inside of the crystal grain is not formed, resulting in that it takes a long time of pickling for dissolving and removing the internal oxide layer.

Figure 4:
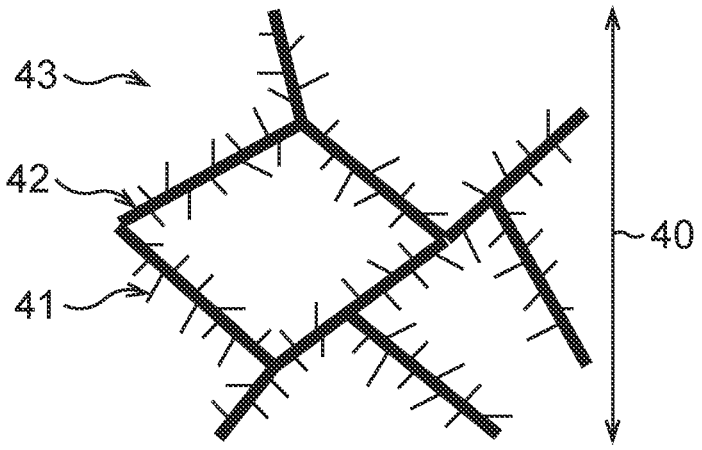
FIG. 4 is a schematic diagram illustrating a shape of oxide in an internal oxide layer disclosed in Patent Reference 4 and indicating that the oxide exists only in the vicinity of a grain boundary.

Further, although Patent Reference 4 makes reference to existence and a shape of an oxide in an internal oxide layer 40 as illustrated in FIG. 4, it has an object to improve plating peeling resistance during high degree of working, and thus is different from the present invention made on the assumption that the removal is performed through the pickling. If, tentatively, this structure is pickled, a region of a dendrite-shaped oxide 41 generated in a crystal grain from a crystal grain boundary 42 is small with respect to the crystal grain having a grain diameter of at least several μm, so that a degree of acid dissolution in the crystal grain in which a proportion of metallic base material 43 having no dendrite-shaped oxide 41 becomes low, and the picklability is not good.

The net-like oxide in the present invention is composed of the $(Fe_x, Mn_{1-x})_2SiO_4$ ($0 \leq x < 1$) and the amorphous $SiO_2$, and $Mn_2SiO_4$ has an oxygen dissociation equilibrium pressure lower than that of $Fe_2SiO_4$, and thus is formed on the inward side of the internal oxide layer. For this reason, the interface between the oxide in the region in which the $(Fe_x, Mn_{1-x})_2SiO_4$ ($0 \leq x < 1$) with high Mn content ratio and the amorphous $SiO_2$ are generated and the metallic parent phase is first dissolved by the pickling solution after dissolving and permeated through the crystal grain boundary. Accordingly, the region having $Fe_2SiO_4$ as a main internal oxide and generated on the outward side of the internal oxide layer can be peeled together with the metallic parent phase and the internal oxide, so that an effect of reducing the pickling time is exhibited. For this reason, it is set that the internal oxide exists in a range of greater than 0% to 30% of a thickness of the internal oxide layer from the interface between the internal oxide layer and the base iron toward a direction of the outward surface layer scale. Note that it is more preferable that the internal oxide exists in a range of greater than 0% to 50% of the thickness of the internal oxide layer from the interface between the internal oxide layer and the base iron toward the direction of the outward surface layer scale.

Although the reason why the interface between the oxide and the metallic parent phase is easily dissolved in the structure of the net-like oxide has not been clear, it can be guessed that the following also exerts influence on the acid dissolubility: the $(Fe_x, Mn_{1-x})_2SiO_4$ ($0 \leq x < 1$) exhibits the acid dissolubility, and in addition to that, in a process of precipitation of the internal oxide in a region being originally a metallic parent phase, cubical expansion occurs due to the generation of the internal oxide, which causes disconformity of the interface between the net-like oxide and the metallic parent phase, and distortion occurs in the metallic parent phase.

A method of checking the net-like oxide structure in the present invention is not particularly limited, and, for example, by processing a cross section in a sheet thickness direction of a hot-rolled coiled material by focused ion beam (FIB) and observing it by a transmission electron microscope, it is possible to check a thickness and a branching portion of the oxide, and a connecting portion of the oxide with a crystal grain boundary. Other than the above, it is also possible to observe a shape of the internal oxide using a scanning electron microscope by polishing the cross section of the hot-rolled coiled material and performing etching using a solution of acid or the like, to thereby silhouette the oxide by utilizing a difference in dissolubility between the internal oxide and the metallic parent phase. Further, a method of observing, with the use of a scanning electron microscope or a transmission electron microscope, an oxide residue collected by performing electroextraction on the above-described hot-rolled coiled material, is also effective.

Further, the net-like oxide structure defined in the present invention indicates a structure in which a thickness in a minor axis direction of the internal oxide containing Si is not less than 10 nm nor more than 200 nm, one or more branches of the internal oxide in the crystal grain exist in any field of view of 1 μm×1 μm square, and in any crystal grain boundary having a length of 1 μm, one or more of the internal oxides in the crystal grain are connected to an internal oxide of the crystal grain boundary. The reason why the thickness in the minor axis direction of the internal oxide is limited to not less than 10 nm nor more than 200 nm, is as follows. When the thickness is less than 10 nm, the dissolving path of the interface between the internal oxide and the metallic parent phase also becomes narrow, and the pickling solution is sometimes difficult to enter the path. Further, when the thickness exceeds 200 nm, a surface area of the net-like oxide becomes small with respect to a total amount of the internal oxides, and a region in which no net-like oxide is generated, is sometimes generated in the crystal grain.

<$(Fe_x, Mn_{1-x})_2SiO_4$>

When the Si/Mn ratio of the steel material components is not less than 0.27 nor more than 0.9, and retention is performed for not less than 10 hours nor more than 20 hours in a range of not less than 400° C. nor more than 500° C., which is a temperature range lower by 50 to 100° C. from the temperature at which the internal oxidation occurs, the oxide represented by the chemical composition of $(Fe_x, Mn_{1-x})_2SiO_4$ ($0 \leq x < 1$) and the amorphous $SiO_2$ are generated to have a net-like structure in substantially the entire area in the crystal grain in the internal oxide layer.

The $(Fe_x, Mn_{1-x})_2SiO_4$ is a complete solid solution of $Fe_2SiO_4$ and $Mn_2SiO_4$, in which x may take any value in a range of not less than 0 nor more than 1. Based on the studies conducted by the present inventors, the Si/Mn ratio of the steel material exerts large influence on the formation of the $(Fe_x, Mn_{1-x})_2SiO_4$. The present inventors found out that when the Si/Mn ratio is 0.90 or less, in particular, a proportion of Fe in the $(Fe_x, Mn_{1-x})_2SiO_4$ tends to become smaller and a proportion of Mn in the $(Fe_x, Mn_{1-x})_2SiO_4$ tends to become larger as a position in the sheet thickness direction of the internal oxide layer becomes inward. The reason thereof can be estimated such that $Mn_2SiO_4$ has a dissociation equilibrium pressure lower than that of $Fe_2SiO_4$, and thus $Mn_2SiO_4$ is easily generated on the inward side of the internal oxide layer having lower oxygen potential. Further, when the Si/Mn ratio exceeds 0.90, the $(Fe_x, Mn_{1-x})_2SiO_4$ does not contain Mn almost at all. Further, a depleted layer of Mn is formed on the interface between the internal oxide layer and the base iron. Accordingly, it can be considered that Mn is diffused from the interface between the internal oxide layer and the base iron to the crystal grain boundary of the internal oxide layer along the crystal grain boundary, and it is further diffused from the crystal grain boundary to the inside of the crystal grain of the internal oxide layer, to form the internal oxide. For this reason, it can be considered that the $(Fe_x, Mn_{1-x})_2SiO_4$ ($0 \leq x < 1$) is formed when Mn is replaced with Fe of $Fe_2SiO_4$, or when Mn or MnO reacts with the amorphous $SiO_2$.

Further, it can be considered that the internal oxide represented by the chemical composition of $(Fe_x, Mn_{1-x})_2SiO_4$ ($0 \leq x < 1$), becomes a gelled Si oxide by being eluted as $Fe^{2+}$ and $Mn^{2+}$ ions in the acid solution. As described above, to provide the acid-dissoluble oxide is also effective for forming the dissolving path at the interface between the oxide and the metallic parent phase, when performing dissolution in the crystal grain in the internal oxide layer.

Although a method of checking the existence of the $(Fe_x, Mn_{1-x})_2SiO_4$ ($0 \leq x < 1$) is not particularly limited, for example, only an oxide scale in a hot-rolled coiled material in which the internal oxide layer is generated, is first dissolved using an acid solution containing an inhibitor. Subsequently, only a metallic parent phase of the internal oxide layer is electrochemically dissolved, and by making the obtained residue to be subjected to filtration and extraction, the internal oxide can be collected. Further, when electrochemically dissolving the parent phase, an amount of metal of the parent phase to be dissolved can be controlled by a quantity of electricity when performing electrolysis. For this reason, by repeatedly performing electroextraction at a predetermined quantity of electricity a plurality of times, extraction of the oxide in a depth direction is also possible. By performing X-ray diffraction on the obtained oxide residue, it is possible to identify the structure of the internal oxide. x in the $(F_x, Mn_{1-x})_2SiO_4$ may take all values of not less than 0 nor more than 1, and by comparing a lattice interval of the same diffracting plane from an X-ray diffraction pattern of the internal oxide obtained by performing extraction on the internal oxide layer in the depth direction, it is possible to know a change from $Fe_2SiO_4$ to $Mn_2SiO_4$. Other than the above, if the observation of the cross section in the sheet thickness direction of the internal oxide layer using a transmission electron microscope and elemental analysis with the use of an energy dispersive X-ray spectroscopy (EDX) are combined, it is also possible to calculate a ratio between Fe and Mn in the $(Fe_x, Mn_{1-x})_2SiO_4$ ($0 \leq x < 1$).

<Amorphous $SiO_2$>

In the steel material components with which the Si-based internal oxide is generated, the amorphous $SiO_2$ with lower oxygen dissociation pressure is generated. When the Si/Mn ratio specified by the present invention is 0.90 or less, in particular, the amorphous $SiO_2$ is observed as one having a net-like structure in a region of the internal oxide represented by the chemical composition of $(Fe_x, Mn_{1-x})_2SiO_4$ ($0 \leq x < 1$).

A method of checking the amorphous $SiO_2$ is not particularly limited. The amorphous $SiO_2$ can be collected as an oxide residue by performing the electrochemical dissolution on the internal oxide layer described above. However, the amorphous $SiO_2$ cannot be checked through the X-ray diffraction since it is amorphous, so that there can be cited a method of analyzing the obtained residue through FT-IR method, for example.

Next, a manufacturing method of a hot-rolled steel sheet and a cold-rolled steel sheet of the present invention will be described. First, a slab having a later-described chemical composition is cast. As the slab to be subjected to hot rolling, a continuously cast slab or one manufactured by a thin slab caster or the like can be used. Further, it is also possible to employ a process such as continuous casting-direct rolling (CC-DR) in which hot rolling is performed right after casting.

In order to secure a finish rolling temperature of equal to or more than an $Ar_3$ transformation point due to reasons to be described later, and further, since reduction in a slab heating temperature may cause excessive increase in a rolling load, resulting in that it may become difficult to perform rolling or a defective shape of a base material steel sheet after the rolling may be caused, the slab heating temperature is preferably set to 1050° C. or more when performing hot rolling on the slab. Although an upper limit of the slab heating temperature is not required to be defined in particular, it is not economically preferable to set the slab heating temperature to an excessively high temperature, so that the slab heating temperature is preferably set to 1350° C. or less.

The hot rolling is preferably finished at the finish rolling temperature equal to or more than the $Ar_3$ transformation point temperature. When the finish rolling temperature is less than the $Ar_3$ transformation point, two-phase rolling of ferrite and austenite is performed, resulting in that a hot-rolled sheet structure easily becomes a heterogeneous mixed grain structure. Further, there is a possibility that even if a cold rolling step and a continuous annealing step are performed, the heterogeneous structure is not eliminated, and ductility and bendability decrease.

Meanwhile, although an upper limit of the finish rolling temperature is not required to be defined in particular, if the finish rolling temperature is set to an excessively high temperature, there is a need to set, in order to secure the temperature, the slab heating temperature to an excessively high temperature. Accordingly, the finish rolling temperature is preferably set to 1100° C. or less.

Note that the $Ar_3$ transformation point (° C.) is calculated through the following expression using contents (mass %) of respective elements.

$$Ar_3=901-325\times C+33\times Si-92\times(Mn+Ni/2+Cr/2+Cu/2+Mo/2)+52\times Al$$

<Coiling Temperature: Not Less Than 550° C. nor More Than 800° C.>

In the high-strength steel sheet targeted by the present invention, a phase transformation from the hot rolling to the coiling is slow due to a high content of alloy, so that when coiling is performed at a low temperature of less than 550° C., a large amount of martensite and retained austenite are generated. In this case, strength of a hot-rolled original sheet is increased, and the steel sheet may fracture during cold rolling. For this reason, there is a need to perform coiling at a temperature of 550° C. or more so that a ferrite transformation and a pearlite transformation are made to progress to cause softening, thereby securing cold rolling property. Experientially, at a temperature of less than 550° C., the internal oxidation does not occur, or even if it occurs, a growth rate in a sheet thickness direction is slow. Although correlation between a temperature and diffusion regarding the occurrence of internal oxidation has not been clear, generally, in a high-strength steel sheet containing Si and Mn of certain amounts or more, 550° C. is a lower limit value of a temperature at which the internal oxidation occurs. Further, as the coiling temperature after performing the hot rolling is higher, it is easier to make the ferrite transformation and the pearlite transformation progress, so that the coiling temperature is more preferably 600° C. or more. When the coiling temperature is 600° C. or more, it is easy to finish the ferrite transformation and the pearlite transformation, resulting in that a structure having further excellent cold rolling property can be provided.

However, at 550° C. or more at which the internal oxidation occurs, there is a tendency that as the temperature becomes higher, the growth of internal oxidation layer easily occurs and a film thickness further increases. This is because a temperature factor becomes a driving force in the generation of internal oxidation layer, and accordingly, excessive increase in the coiling temperature causes increase in film thickness of the internal oxide layer, and the picklability deteriorates. In particular, the tendency becomes significant when the coiling temperature exceeds 800° C., and the thickness of the internal oxide layer exceeds 30 μm, which is not favorable from a viewpoint of productivity and yield. Therefore, the upper limit of the coiling temperature is 800° C. In order to further increase the picklability, the coiling temperature is preferably 700° C. or less.

<Retention of Coiled Steel Sheet for Not Less Than 10 Hours nor More Than 20 Hours at Not Less Than 400° C. nor More Than 500° C.>

Although the effect regarding the acid dissolubility of the net-like oxide is described above, it is not possible to significantly improve the picklability of the internal oxide layer only by generating the oxide represented by the chemical composition of $(Fe_x, Mn_{1-x})_2SiO_4$ ($0\leq x<1$) and the amorphous $SiO_2$. The internal oxides have to be formed not only in the crystal grain boundary and the vicinity of the grain boundary but also inside of the crystal grain from the crystal grain boundary in a continuous manner while dispersing in substantially the entire area in the crystal grain. Accordingly, it was found out that by performing control of heat quantity when growth of the internal oxidation layer occurs, in addition to the control of Si/Mn ratio, the oxide having the net-like structure in the crystal grain can be grown.

However, generally, when the coiling temperature is increased in order to apply heat quantity when the internal oxidation layer occurs, the growth of internal oxidation occurs in the sheet thickness direction of the steel material and the film thickness increases, so that it is difficult to reduce the pickling time. Accordingly, if retention is performed in a temperature range lower by 50° C. to 100° C. from the temperature at which the internal oxidation occurs, for not about 1 to 5 hours being a conventional treatment time, but 10 hours or more, it is possible to make the internal oxidation progress from the crystal grain boundary to the inside of the crystal grain of the internal oxide layer while preventing the increase in film thickness. Although this mechanism is not clear, at the interface between the internal oxide layer and the base iron, a depleted layer of Si and Mn is generated, and Si and Mn are diffused to the internal oxide layer through the crystal grain boundary. At this time, once the depleted layer of Mn and Si is generated, it is difficult for the internal oxide layer to be generated on the inward side any more. In addition to that, when the retention is performed for a long period of time at a temperature which is relatively close to the coiling temperature, the internal oxidation progresses from the crystal grain boundary to the inside of the crystal grain, while keeping the thickness of the internal oxide layer constant. Further, it is assumed that in the region where the Si-based oxide represented by the $(Fe_x, Mn_{1-x})_2SiO_4$ ($0\leq x<1$) containing Mn and the amorphous $SiO_2$ is generated, the growth of internal oxide progresses in the crystal grain.

Here, a retention temperature after performing the coiling is not less than 400° C. nor more than 500° C. If the retention temperature exceeds 500° C., the temperature becomes close to 550° C. being a temperature at which the internal oxidation occurs, so that the growth in the sheet thickness direction may progress, and the increase in film thickness may occur. On the other hand, if the retention temperature is less than 400° C., a rate at which Si and Mn are diffused from the crystal grain boundary to the inside of the crystal grain is limited, resulting in that the generation of internal oxide in the crystal grain becomes extremely slow.

Further, a lower limit of the retention time in this temperature range is 10 hours. If the retention time is less than 10 hours, a region where the net-like oxide is not generated, is sometimes generated. The retention time is more preferably 15 hours or more. If the retention time is 15 hours or more, even in a crystal grain with a large grain diameter size of several μm or more, it is possible to make the net-like oxide grow in the entire area in the crystal grain. Further, an upper limit of the retention time is 20 hours. The retention time exceeding 20 hours is not preferable since an inclusion such as a carbide is generated in the base iron, and the productivity decreases. The retention time in this case requires not less than 10 hours nor more than 20 hours, but, this is not included in a continuous step of hot rolling, pickling, cold rolling, and the like in a manufacturing process, and thus is out of online, so that influence exerted on the productivity and the cost is relatively small.

<Pickling of Hot-Rolled Coiled Material>

The steel material after being subjected to the hot rolling and then the coiling is pickled to remove the oxide scale of the steel material surface layer portion and the internal oxide layer. Depending on circumstances, a metallic iron layer is sometimes generated in the oxide scale and on the surface layer of the oxide scale when oxygen in the oxide scale is consumed by the internal oxidation, and the metallic iron layer is also required to be removed through the pickling. The oxide on the surface of the steel sheet can be removed by the pickling, and the pickling is important from a point of improving conversion property of a high-strength cold-rolled steel sheet of a final product, and a point of improving hot-dipping platability of a cold-rolled steel sheet for hot-dip galvanized steel sheet or alloyed hot-dip galvanized steel sheet. The pickling may be performed by only one time of treatment, or performed dividedly in a plurality of times.

A composition of liquid used for the pickling targeted by the present invention is not particularly limited as long as it is generally used for removing an oxide scale of a steel sheet, and it is possible to use, for example, dilute hydrochloric acid, dilute sulfuric acid, or nitrohydrofluoric acid. When economic efficiency and a pickling rate are taken into consideration, the use of hydrochloric acid is preferable. A concentration of hydrochloric acid is preferably not less than 1 mass % nor more than 20 mass % as hydrogen chloride. When the concentration of hydrochloric acid is higher, a rate of dissolution of the oxide scale and the internal oxide layer can be increased, but, at the same time, a dissolution amount of the base iron after the dissolution is also increased. For this reason, the yield lowers or supply of hydrochloric acid with high concentration is required, which leads to increase in cost, so that the above-described range is preferable. Further, in the acid solution, components derived from the steel sheet including iron (II) ions and iron (III) ions may be mixed through dissolution. Further, a temperature of the acid solution is preferably not less than 70° C. nor more than 95° C. When the temperature is higher, the rate of dissolution of the oxide scale and the internal oxide layer can be increased, but, at the same time, the dissolution amount of the base iron after the dissolution is also increased, which causes reduction in yield or increase in cost due to the increase in temperature, so that an upper limit of the temperature of the acid solution is preferably 95° C. Further, when the temperature of the acid solution is low, the rate of dissolution of the scale and the base iron is low, and the productivity reduces by lowering a sheet passage speed, so that a lower limit of the temperature of the acid solution is preferably 70° C. The temperature of the acid solution is more preferably not less than 80° C. nor more than 90° C. Further, it is possible to add a commercially available pickling inhibitor (inhibitor) to the pickling solution, in order to prevent over-dissolution and yellowing of the base iron. Further, it is also possible to add a commercially available pickling accelerator to the pickling solution, in order to accelerate the dissolution of the oxide scale and the metallic iron.

Further, in the internal oxide layer having the internal oxide with the net-like structure continued from the crystal grain boundary, the dissolution in the crystal grain progresses when the pickling solution permeated through the crystal grain boundary dissolves the interface between the net-like oxide and the metallic parent phase. Further, in the internal oxide layer having the net-like oxide, the interface to be the starting point of dissolution further increases, and there exists the internal oxide with high dissolubility. For this reason, when compared to the conventional internal oxide layer in which no net-like oxide exists, and there is a need to dissolve the metallic parent phase of the internal oxide layer, it is possible to lower the acid concentration, the acid temperature, and the iron ion concentration.

Further, when the hot-rolled steel sheet having the internal oxide layer is pickled under the above-described general pickling conditions, the thickness of the internal oxide layer is set to not less than 1 μm nor more than 30 μm, in order to greatly reduce the pickling time. When the thickness of the internal oxide layer is less than 1 μm, there is exhibited a small effect of making the pickling solution permeate through the inside of the crystal grain by setting the interface between the oxide generated in the crystal grain from the crystal grain boundary in a continuous manner and the metallic parent phase as the dissolving path, due to the small thickness of the internal oxide layer. On the other hand, when the thickness of the internal oxide layer exceeds 30 μm, there is an effect of making the pickling solution permeate through the inside of the crystal grain, but, it takes a long time for making the pickling solution permeate up to the crystal grain boundary at a lower portion of the internal oxide layer, resulting in that the effect of reducing the pickling time becomes small as a whole. Further, this is not favorable also from a viewpoint of yield.

<Cold Rolling>

The hot-rolled steel sheet having the internal oxide structure which is easily pickled, and targeted by the present invention, is used as a cold-rolled steel sheet by being subjected to pickling and then cold rolling. However, generally, excessively high strength of the hot-rolled steel sheet causes fracture and the like during cold rolling and cold rolling property cannot be secured, so that there is a need to finish the ferrite transformation and the pearlite transformation. Further, when the content of Mn in the steel material is too high, the weldability deteriorates, which exerts influence also on the cold rolling property. If the Si/Mn ratio when the Mn content in the steel material is 3.6 mass % and the Si content in the steel material is 1.0 mass % is 0.27 or more, it is possible to secure the cold rolling property. Further, if the cold rolling is performed without completely removing the internal oxide layer through the pickling, a crack occurs due to peeling of the remaining internal oxide layer, which causes deterioration of conversion property or occurrence of pickup on a surface of hearth roll during annealing. Accordingly, in order to obtain properties as the cold-rolled steel sheet, the internal oxide layer of the hot-rolled coiled material has to be completely removed through the pickling. The present invention tries to reduce the pickling time to improve the productivity by making the structure of the internal oxide layer generated during the coiling after the hot rolling to be one which is easily pickled, while maintaining the properties as the cold-rolled steel sheet.

Next, explanation will be made on the reason why the composition of the hot-rolled steel sheet and the slab is limited as described above. The present invention sets the high-strength steel sheet containing C, Si, and Mn as a target, and the reason of setting of the contents of the respective elements other than Fe in the steel sheet and the slab will be described below. Note that also in the slab, the Si/Mn ratio is set to not less than 0.27 nor more than 0.9, based on the reason similar to the above.

<C: Not Less Than 0.05 Mass % nor More Than 0.45 Mass %>

C is an element required to obtain a retained austenite phase, and is contained to realize both of excellent formability and high strength. If the C content exceeds 0.45 mass %, the weldability becomes insufficient, so that an upper limit of the C content is set to 0.45 mass %. On the other hand, if the C content is less than 0.05 mass %, it becomes difficult to obtain a sufficient amount of retained austenite phase, resulting in that the strength and the formability reduce. From a viewpoint of the strength and the formability, a lower limit of the C content is set to 0.05 mass %.

<Si: Not Less Than 0.5 Mass % nor More Than 3.00 Mass %>

Si is an element with which it becomes easy to obtain the retained austenite phase by suppressing generation of an iron-based carbide in the steel sheet, and is required to increase the strength and the formability. The Si content exceeding 3.00 mass % causes embrittlement of the steel sheet, which deteriorates the ductility, so that an upper limit of the Si content is set to 3.00 mass %. On the other hand, if the Si content is less than 0.5 mass %, the iron-based carbide is generated during a period of time in which the temperature is cooled to room temperature after the annealing, and it is not possible to sufficiently obtain the retained austenite phase. As a result of this, the strength and the formability deteriorate, the activity is low, and the internal oxidation during the hot rolling is difficult to occur, so that a lower limit of the Si content is set to 0.5 mass %.

<Mn: Not Less Than 0.50 Mass % nor More Than 3.60 Mass %>

Mn is contained to increase the strength of the steel sheet, and further, it is an important element to stabilize austenite and to obtain the properties as the high-strength steel sheet excellent in workability through generation of retained austenite. If the Mn content exceeds 3.60 mass %, the embrittlement easily occurs, and a crack of cast slab easily occurs. Further, if the Mn content exceeds 3.60 mass %, there is a problem that the weldability also deteriorates. For this reason, an upper limit of the Mn content is set to 3.60 mass %. On the other hand, if the Mn content is less than 0.50 mass %, a large amount of soft structure is generated during the cooling after the annealing, which makes it difficult to secure the strength. Further, since the activity is low, and the internal oxidation during the hot rolling is difficult to occur, a lower limit of the Mn content is set to 0.50%.

There is no problem that the hot-rolled steel sheet and the slab of the present invention contain, in addition to the above-described components, the following alloying elements in order to satisfy the properties as the high-strength steel sheet or as inevitable impurities in manufacturing.

<P: 0.030 Mass % or Less>

P tends to segregate on a center portion in a sheet thickness of the steel sheet, and has a property to cause embrittlement of a welded portion. The P content exceeding 0.030 mass % causes significant embrittlement of the welded portion, so that P is contained in an amount of 0.030 mass % or less. However, if the P content is set to less than 0.001%, a manufacturing cost significantly increases, so that the P content is preferably set to 0.001 mass %.

<S: 0.0100 Mass % or Less>

S exerts an adverse effect on the weldability and manufacturability during casting and hot rolling, and S binds with Mn to form coarse MnS to reduce the ductility and stretch flangeability, so that the S content is set to 0.0100 mass % or less. However, if the S content is set to less than 0.0001 mass %, the manufacturing cost significantly increases, so that the S content is preferably set to 0.0001 mass % or more.

<Al: 1.500 Mass % or Less>

Al is an element which suppresses the generation of the iron-based carbide to make it easy to obtain retained austenite, and increases the strength and the formability of the steel sheet. If the Al content exceeds 1.500 mass %, the weldability deteriorates, so that the Al content is set to 1.500 mass % or less. However, Al is an effective element also as a deoxidizing material, and if the Al content is less than 0.005 mass %, it is not possible to sufficiently achieve the effect as the deoxidizing material, so that in order to sufficiently achieve the effect of deoxidation, the Al content is preferably 0.005 mass % or more.

<N: 0.0100 Mass % or Less>

N forms a coarse nitride to deteriorate the ductility and the stretch flangeability, so that an addition amount thereof has to be suppressed. This tendency becomes significant when the N content exceeds 0.0100 mass %, so that the N content is set to 0.0100 mass % or less. On the other hand, if the N content is set to less than 0.0001 mass %, the manufacturing cost significantly increases, so that the N content is preferably set to 0.0001 mass % or more.

<O: 0.0100 Mass % or Less>

O forms an oxide, and if the O content exceeds 0.0100 mass %, the ductility and the stretch flangeability significantly deteriorate, so that the O content is set to 0.0100 mass % or less. On the other hand, if the O content is set to less than 0.0001 mass %, the manufacturing cost significantly increases, so that the O content is preferably set to 0.0001 mass % or more.

<Ti: 0.150 Mass % or Less>

Ti is an element which contributes to the increase in strength of the steel sheet by precipitate strengthening, fine grain strengthening through growth suppression of ferrite crystal grain, and dislocation strengthening through suppression of recrystallization. If the Ti content exceeds 0.150 mass %, precipitation of a carbon nitride increases to deteriorate the formability, so that the Ti content is set to 0.150 mass % or less. Further, in order to sufficiently achieve the effect of increasing the strength by Ti, the Ti content is preferably 0.005 mass % or more.

<Nb: 0.150 Mass % or Less>

Nb is an element which contributes to the increase in strength of the steel sheet by the precipitate strengthening, the fine grain strengthening through the growth suppression of the ferrite crystal grain, and the dislocation strengthening through the suppression of recrystallization. If the Nb content exceeds 0.150 mass %, precipitation of the carbon nitride increases to deteriorate the formability, so that the Nb content is set to 0.150 mass % or less. Further, in order to sufficiently achieve the effect of increasing the strength by Nb, the Nb content is preferably 0.010 mass % or more.

<V: 0.150 Mass % or Less>

V is an element which contributes to the increase in strength of the steel sheet by the precipitate strengthening, the fine grain strengthening through the growth suppression of the ferrite crystal grain, and the dislocation strengthening through the suppression of recrystallization. If the V content exceeds 0.150 mass %, precipitation of the carbon nitride increases to deteriorate the formability, so that the V content is set to 0.150 mass % or less. Further, in order to sufficiently achieve the effect of increasing the strength by V, the V content is preferably 0.005 mass % or more.

<B: 0.0100 Mass % or Less>

B is an effective element for high strengthening by suppressing a phase transformation under a high temperature, and is contained in place of a part of C or Mn. If the B content exceeds 0.0100 mass %, the workability during hot working is impaired and the productivity lowers, so that the B content is set to 0.0100 mass % or less. Further, in order to sufficiently achieve the effect of increasing the strength by B, the B content is preferably 0.0001 mass % or more.

<Mo: 1.00 Mass % or Less>

Mo is an effective element for high strengthening by suppressing the phase transformation under a high temperature, and is contained in place of a part of C or Mn. If the Mo content exceeds 1.00 mass %, the workability during hot working is impaired and the productivity lowers, so that the Mo content is set to 1.00 mass % or less. In order to sufficiently achieve the effect of increasing the strength by Mo, the Mo content is preferably 0.01 mass % or more.

<W: 1.00 Mass % or Less>

W is an effective element for high strengthening by suppressing the phase transformation under a high temperature, and is contained in place of a part of C or Mn. If the W content exceeds 1.00 mass %, the workability during hot working is impaired and the productivity lowers, so that the W content is set to 1.00 mass % or less. Further, in order to sufficiently achieve the effect of increasing the strength by W, the W content is preferably 0.01 mass % or more.

<Cr: 2.00 Mass % or Less>

Cr is an effective element for high strengthening by suppressing the phase transformation under a high temperature, and is contained in place of a part of C or Mn. If the Cr content exceeds 2.00 mass %, the workability during hot working is impaired and the productivity lowers, so that the Cr content is set to 2.00 mass % or less. Further, in order to sufficiently achieve the effect of increasing the strength by Cr, the Cr content is preferably 0.01 mass % or more.

<Ni: 2.00 Mass % or Less>

Ni is an effective element for high strengthening by suppressing the phase transformation under a high temperature, and is contained in place of a part of C or Mn. If the Ni content exceeds 2.00 mass %, the weldability is impaired, so that the Ni content is set to 2.00 mass % or less. Further, in order to sufficiently achieve the effect of increasing the strength by Ni, the Ni content is preferably 0.01 mass % or more.

<Cu: 2.00 Mass % or Less>

Cu is an element which increases the strength by being existed in the steel as a fine particle, and is contained in place of a part of C or Mn. If the Cu content exceeds 2.00 mass %, the weldability is impaired, so that the Cu content is set to 2.00 mass % or less. Further, in order to sufficiently achieve the effect of increasing the strength by Cu, the Cu content is preferably 0.01 mass % or more.

<Total of One Kind or Two Kinds or More Selected from Group Consisting of Ca, Ce, Mg, Zr, Hf, and REM: 0.5000 Mass % or Less>

Ca, Ce, Mg, Zr, Hf, and REM are elements effective for improving the formability, and one kind or two kinds or more thereof are contained. Here, REM is an abbreviation of Rare Earth Metal, and indicates an element which belongs to lanthanoide series. If the content of one kind or two kinds or more selected from the group consisting of Ca, Ce, Mg, Zr, Hf, and REM exceeds 0.5000 mass % in total, the ductility may be impaired, so that the total of the contents of the respective elements is set to 0.5000 mass % or less. Further, in order to sufficiently achieve the effect of improving the formability of the steel sheet, the total of the contents of the respective elements is preferably 0.0001 mass % or more.

Further, there is no problem if elements other than the aforementioned elements are contained as impurities derived from a raw material, for example, within a range not impairing the properties as the high-strength steel sheet, such as the strength, the formability (the ductility, the stretch flangeability), and the weldability.

EXAMPLES

Hereinafter, the present invention will be described more concretely using Examples. However, the present invention is not limited at all by these Examples.

<Steel Material Components, Hot Rolling and Coiling>

Slabs having chemical components of steel materials No. A to No. Z represented in Table 1 were cast, heated at 1250° C., and then subjected to hot rolling at a finishing temperature of 870° C. to 900° C. until a thickness of each slab reached 3.0 mm. After that, coiling was performed at temperatures represented in Table 2, and then cooling was conducted while performing retention for a certain period of time in a temperature range from 400° C. to 500° C.

<Thickness of Internal Oxide Layer, Presence/Absence of Internal Oxide in Crystal Grain and Internal Oxide of Crystal Grain Boundary>

Regarding each of the hot-rolled steel sheets having the chemical components represented in Table 1 and obtained by performing coiling and heat treatment represented in Table 2, a thickness of the internal oxide layer was determined from an average value obtained when observing 10 visual fields at any cross section in a sheet thickness direction of the hot-rolled steel sheet in a range where the internal oxide layer is included in one visual field, by using a scanning electron microscope (JSM-6500F, manufactured by JEOL Ltd.) at 1000 to 5000 magnifications. At this time, the thickness of the internal oxide layer was set to a distance from an interface between an oxide scale generated on a surface layer and the internal oxide layer to an interface between the internal oxide layer and base iron. Note that a depth in the sheet thickness direction of a grain boundary oxide at the interface between the internal oxide layer and the base iron and the internal oxide in the crystal grain is not uniform, and varies depending on a portion of the cross section of the observation target. Accordingly, in the observation, a face at which the internal oxide of the crystal grain boundary positioned closest to the base iron side with respect to the sheet thickness direction and a terminal of the internal oxide in the crystal grain were connected, was specified, and the face was set as the interface between the internal oxide layer and the base iron. Further, regarding the presence/absence of the internal oxide in the crystal grain and the internal oxide of the crystal grain boundary, if there existed the internal oxide in the crystal grain and at the crystal grain boundary in 10 visual fields at the cross section observed at 5000 magnifications, the determination was made as presence, and if there existed no such an internal oxide in the above, the determination was made as absence.

<Si-Containing Internal Oxide, Thickness of Internal Oxide, Branch of Internal Oxide, Connection of Internal Oxides of Crystal Grain Boundary and Inside of Crystal Grain>

Regarding each of the hot-rolled steel sheets having the chemical components represented in Table 1 and obtained by performing the coiling and the heat treatment under the conditions represented in Table 2, the presence/absence of Si in the internal oxide in the crystal grain of the internal oxide layer, the thickness of the internal oxide in the crystal grain, the number of branches of the internal oxide in the crystal grain, and the number of connections of the internal oxides of the crystal grain boundary and inside of the crystal grain, were determined through the following procedure. First, there was produced a flaky sample obtained by processing the cross section in the sheet thickness direction of the internal oxide layer using a focused ion beam (Crossbeam 1540 ESB, manufactured by ZEISS). Further, by using a transmission electron microscope (Tecnai G2 F30, manufactured by FEI Company), any cross section of 1 μm×1 μm square in a range of not less than 0% nor more than 30% of a thickness of the internal oxide layer from the interface between the internal oxide layer and the base iron toward the direction of the surface layer oxide scale, was observed at 80000 magnifications, to thereby determine these. Further, in the observation, a face at which the internal oxide of the crystal grain boundary of the internal oxide layer positioned closest to the base iron side with respect to the sheet thickness direction and a terminal of the internal oxide were connected, was specified, and the face was set as the interface between the internal oxide layer and the base iron.

TABLE 1

| STEEL MATERIAL | STEEL COMPONENT/MASS % | | | | | | | | | |
|---|---|---|---|---|---|---|---|---|---|---|
| No. | C | Si | Mn | P | S | Al | Ti | Ni | Si/Mn | REMARKS |
| A | 0.20 | 1.00 | 4.00 | 0.01 | 0.002 | 0.03 | 0.005 | 0.003 | 0.25 | COMPARATIVE EXAMPLE |
| B | 0.20 | 1.00 | 3.60 | 0.01 | 0.002 | 0.03 | 0.005 | 0.003 | 0.27 | EXAMPLE |
| C | 0.20 | 1.00 | 2.00 | 0.01 | 0.002 | 0.03 | 0.005 | 0.003 | 0.50 | EXAMPLE |
| D | 0.20 | 1.00 | 1.45 | 0.01 | 0.002 | 0.03 | 0.005 | 0.003 | 0.69 | EXAMPLE |
| E | 0.20 | 1.00 | 1.33 | 0.01 | 0.002 | 0.03 | 0.005 | 0.003 | 0.75 | EXAMPLE |
| F | 0.20 | 1.00 | 1.12 | 0.01 | 0.002 | 0.03 | 0.005 | 0.003 | 0.89 | EXAMPLE |
| G | 0.20 | 1.00 | 1.05 | 0.01 | 0.002 | 0.03 | 0.005 | 0.003 | 0.95 | COMPARATIVE EXAMPLE |
| H | 0.25 | 2.00 | 3.57 | 0.01 | 0.002 | 0.03 | 0.005 | 0.003 | 0.56 | EXAMPLE |
| I | 0.25 | 2.00 | 2.90 | 0.01 | 0.002 | 0.03 | 0.005 | 0.003 | 0.69 | EXAMPLE |
| J | 0.25 | 2.00 | 2.67 | 0.01 | 0.002 | 0.03 | 0.005 | 0.003 | 0.75 | EXAMPLE |
| K | 0.25 | 2.00 | 2.25 | 0.01 | 0.002 | 0.03 | 0.005 | 0.003 | 0.89 | EXAMPLE |
| L | 0.25 | 2.00 | 2.20 | 0.01 | 0.002 | 0.03 | 0.005 | 0.003 | 0.91 | COMPARATIVE EXAMPLE |
| M | 0.40 | 3.00 | 3.37 | 0.01 | 0.002 | 0.03 | 0.005 | 0.003 | 0.89 | EXAMPLE |
| N | 0.40 | 3.00 | 3.16 | 0.01 | 0.002 | 0.03 | 0.005 | 0.003 | 0.95 | COMPARATIVE EXAMPLE |
| O | 0.20 | 1.00 | 2.00 | 0.01 | 0.002 | 0.03 | 0.005 | 0.003 | 0.50 | COMPARATIVE EXAMPLE |
| P | 0.20 | 1.00 | 2.00 | 0.01 | 0.002 | 0.03 | 0.005 | 0.003 | 0.50 | EXAMPLE |
| Q | 0.20 | 1.00 | 2.00 | 0.01 | 0.002 | 0.03 | 0.005 | 0.003 | 0.50 | EXAMPLE |
| R | 0.20 | 1.00 | 2.00 | 0.01 | 0.002 | 0.03 | 0.005 | 0.003 | 0.50 | EXAMPLE |
| S | 0.20 | 1.00 | 2.00 | 0.01 | 0.002 | 0.03 | 0.005 | 0.003 | 0.50 | EXAMPLE |
| T | 0.20 | 1.00 | 2.00 | 0.01 | 0.002 | 0.03 | 0.005 | 0.003 | 0.50 | COMPARATIVE EXAMPLE |
| U | 0.20 | 1.00 | 1.33 | 0.01 | 0.002 | 0.03 | 0.005 | 0.003 | 0.75 | COMPARATIVE EXAMPLE |
| V | 0.20 | 1.00 | 1.33 | 0.01 | 0.002 | 0.03 | 0.005 | 0.003 | 0.75 | EXAMPLE |
| W | 0.20 | 1.00 | 1.33 | 0.01 | 0.002 | 0.03 | 0.005 | 0.003 | 0.75 | EXAMPLE |
| X | 0.20 | 1.00 | 1.33 | 0.01 | 0.002 | 0.03 | 0.005 | 0.003 | 0.75 | EXAMPLE |
| Y | 0.20 | 1.00 | 1.33 | 0.01 | 0.002 | 0.03 | 0.005 | 0.003 | 0.75 | EXAMPLE |
| Z | 0.20 | 1.00 | 1.33 | 0.01 | 0.002 | 0.03 | 0.005 | 0.003 | 0.75 | COMPARATIVE EXAMPLE |

The thickness of the internal oxide in the internal oxide layer was determined in a manner that regarding 20 oxides included in any visual field, if a length in a unit of nm in a minor axis direction of each of the oxides was not less than 10 nm nor more than 200 nm, the determination was made as ○, and if the length was in a range out of the above, the determination was made as x.

Regarding how to count the number of branches of the internal oxide described above, the method illustrated in FIG. 3 was employed as described above, and the number was calculated from an average value of the number of branches in 20 oxides included in any visual field.

Regarding a number of connections of the internal oxides of the crystal grain boundary and inside of the crystal grain, in any crystal grain boundary with a length of 1 μm in any five visual fields each having a crystal grain boundary of continuous length of 1 μm or more, a number of internal oxides each of which exists by being extended from the crystal grain boundary to the inside of the crystal grain by 100 nm or more in a continuous manner, was calculated, and an average value thereof was calculated.

Further, with respect to the internal oxide after calculating the thickness of the internal oxide, the number of branches of the internal oxide, and the number of connections of the internal oxides of the crystal grain boundary and inside of the crystal grain, elemental analysis was performed using an energy dispersive X-ray spectroscopy (Tecnai G2 F30, manufactured by FEI Company), and the determination was made as presence if the Si component was detected, and the determination was made as absence if the Si component was not detected.

Table 3 represents results of these measurements.

<Presence/Absence of Existence of $(Fe_x, Mn_{1-x})_2SiO_4$ ($0 \leq x < 1$) and Amorphous $SiO_2$>

The composition of the oxide in the internal oxide layer was specified through the following procedure. First, a coiled material was immersed in a citric acid aqueous solution of 10 mass % at 50° C. containing 400 ppm of commercially available inhibitor (IBIT 710, manufactured by ASAHI Chemical Co., Ltd.) until an oxide scale layer was dissolved. After that, electrolysis was performed at a current density of about 320 $Am^{-2}$ in a methanol solution containing 10 mass % of acetylacetone and 1 mass % of tetramethylammonium chloride to electrochemically dissolve only metallic iron of about 5 μm in thickness, and an oxide residue was collected on a filter of 0.1 μm×35 mmϕ. This operation was repeatedly conducted a plurality of times until a metallic parent phase of the internal oxide layer was dissolved, to thereby extract the internal oxide in a depth direction. The extracted residue was subjected to X-ray diffraction by continuous scan of θ/2θ method (RINT1500, manufactured by Rigaku Corporation, scan speed: 0.4°

$min^{-1}$, sampling width: 0.010°), thereby checking the presence/absence of existence of the $(Fe_x, Mn_{1-x})_2SiO_4$ ($0 \leq x < 1$).

Further, the residue obtained through the electroextraction and a potassium bromide crystal were mixed and pressed into a tablet, and then by using FT/IR6100 manufactured by JASCO Corporation, measurement was performed through a transmission method of FT-IR (detector: TGS, resolution: 4 $cm^{-1}$, integrated number of times: 100, size of measurement: 10 mmϕ), to thereby examine the presence/absence of existence of the amorphous $SiO_2$.

<Content Ratio of Fe and Mn in $(Fe_x, Mn_{1-x})_2SiO_4$ ($0 \leq x < 1$)>

Further, by comparing lattice intervals of a diffracting plane common to $Fe_2SiO_4$ and $Mn_2SiO_4$, a change in the content ratio of Fe and Mn in the $(Fe_x, Mn_{1-x})_2SiO_4$ ($0 \leq x < 1$) was examined. In a case of a (111) plane, the lattice interval is 3.556 nm regarding $Fe_2SiO_4$, and the lattice interval is 3.627 nm regarding $Mn_2SiO_4$. First, the residue obtained through the electroextraction was subjected to X-ray diffraction by continuous scan of θ/2θ method (RINT1500, manufactured by Rigaku Corporation, scan speed: 0.4° $min^{-1}$, sampling width: 0.010°). As a result of this, as the lattice interval of the (111) plane approaches 3.627 nm, it is indicated that the proportion of Mn in the $(Fe_x, Mn_{1-x})_2SiO_4$ becomes high, namely, it was determined that as the lattice interval of the (111) plane approached 3.627 nm, the value of x became small. At this time, if the proportion of Mn was monotonously increased toward the inward side of the internal oxide layer, the determination was made as o, if the proportion was constant without being increased at a part of the layer, the determination was made as A, and if the proportion was constant or reduced in the entire layer, the determination was made as x. Results of these are represented in a column of "tendency that x in $(Fe_x, Mn_{1-x})_2SiO_4$ ($0 \leq x < 1$) becomes small toward inward side" in the item of Table 2.

<Position of Existence of Net-Like Oxide>

Regarding whether or not the oxide containing Si and having the net-like structure existed in a range of not less than 0% nor more than 50% of a thickness of the internal oxide layer from the interface between the internal oxide layer and the base iron toward the direction of the surface layer oxide scale, was determined based on the thickness of the internal oxide, the presence/absence of branch of the internal oxide, and the presence/absence of connection of the internal oxides of the crystal grain boundary and inside of the crystal grain, in the range, through a method similar to the above method. At this time, observation was performed by using the transmission electron microscope (Tecnai G2 F30, manufactured by FEI Company) at 80000 magnifications, and in any 10 visual fields of 1 gm x 1 μm square, if there existed the net-like oxide in all of the visual fields, the determination was made as ○, if the existence was confirmed in not less than 1 visual field nor more than 9 visual fields, the determination was made as Δ, and if the existence was not confirmed even in 1 visual field, the determination was made as x. Results of these measurements are presented in a column of "net-like structure in range of 0 to 50% of thickness of internal oxide layer from interface between internal oxide layer and base iron" in Table 2.

<Pickling>

Regarding each of the hot-rolled steel sheets having the chemical components represented in Table 1 and obtained by performing the coiling and the heat treatment under the conditions represented in Table 2, the picklability was evaluated based on a pickling finish time required for dissolving and removing the internal oxide layer.

In the pickling, the coiled material was immersed in a hydrochloric acid aqueous solution of 9 mass % at 85° C. containing 80 g/L of iron (II) ions, 1 g/L of iron (III) ions, and 400 ppm of commercially available inhibitor (IBIT 710, manufactured by ASAHI Chemical Co., Ltd.) Further, a period of time taken for removing the crystal grain including the metallic parent phase of the internal oxide layer was set to the pickling finish time. Note that the pickling finish time was measured in a unit of 5 seconds, in terms of error range of experiment. Further, the determination regarding the removal of the internal oxide layer was conducted by performing visual observation of the surface of the steel material and by observing a cross section of the pickled hot-rolled steel sheet using a scanning electron microscope (JSM-6500F, manufactured by JEOL Ltd.) at 1000 to 5000 magnifications, within a range in which the internal oxide layer was included in one visual field.

Note that regarding the pickling finish time, the aforementioned Patent Reference 1 being the conventional technique proposes that, in a case of a hot-rolled steel sheet which requires 45 seconds for dissolving an oxide scale, the pickling has to be performed for 90 seconds or more when a grain boundary oxide layer has 5 μm, the pickling has to be performed for 135 seconds or more when the layer has 10 μm, the pickling has to be performed for 180 seconds or more when the layer has 15 μm, and the pickling has to be performed for 225 seconds or more when the layer has 20 μm, and a period of time corresponding to ⅔ of each of the above was set to a target pickling time.

<Cold Rolling>

Further, in order to evaluate the cold rolling property, the hot-rolled steel sheets after being subjected to the pickling treatment for the target pickling time of 60 seconds when the thickness of the internal oxide layer was 5 μm or less, 90 seconds when the thickness was greater than 5 μm and equal to or less than 10 μm, 120 seconds when the thickness was greater than 10 μm and equal to or less than 15 μm, and 150 seconds when the thickness was greater than 15 μm, were subjected to rolling treatment by using a cold rolling mill until the sheet thickness reached 1.5 mm.

[Table 2]

TABLE 2

| STEEL SHEET No. | STEEL MATERIAL No. | Si/Mn | COILING TEMPERATURE/ ° C. | RETENTION TIME AT NOT LESS THAN 400° C. NOR MORE THAN 500° C./ HOUR | THICKNESS OF INTERNAL OXIDE LAYER/μm | INTERNAL OXIDES OF CRYSTAL GRAIN BOUNDARY AND INSIDE OF CRYSTAL GRAIN | NET-LIKE OXIDE IN RANGE OF 0 TO 30% OF THICKNESS OF INTERNAL OXIDE LAYER FROM INTERFACE BETWEEN INTERNAL OXIDE LAYER AND BASE IRON: INTERNAL OXIDE IN Si-CONTAINING CRYSTAL GRAIN | THICKNESS OF INTERNAL OXIDE/nm | NUMBER OF BRANCHES OF INTERNAL OXIDE | NUMBER OF CONNECTIONS OF INTERNAL OXIDES OF CRYSTAL GRAIN BOUNDARY AND INSIDE OF CRYSTAL GRAIN |
|---|---|---|---|---|---|---|---|---|---|---|
| 1 | A | 0.25 | 650 | 15 | 15 | PRESENCE | PRESENCE | ○ | 34 | 8 |
| 2 | B | 0.27 | 650 | 15 | 18 | PRESENCE | PRESENCE | ○ | 36 | 11 |
| 3 | C | 0.50 | 650 | 15 | 19 | PRESENCE | PRESENCE | ○ | 39 | 9 |
| 4 | D | 0.69 | 650 | 15 | 15 | PRESENCE | PRESENCE | ○ | 35 | 12 |
| 5 | E | 0.75 | 650 | 15 | 17 | PRESENCE | PRESENCE | ○ | 12 | 5 |
| 6 | F | 0.89 | 650 | 15 | 15 | PRESENCE | PRESENCE | ○ | 7 | 3 |
| 7 | G | 0.95 | 650 | 15 | 18 | PRESENCE | PRESENCE | ○ | 0 | 2 |
| 8 | H | 0.56 | 750 | 15 | 25 | PRESENCE | PRESENCE | ○ | 37 | 7 |
| 9 | I | 0.69 | 750 | 15 | 23 | PRESENCE | PRESENCE | ○ | 34 | 8 |
| 10 | J | 0.75 | 750 | 15 | 22 | PRESENCE | PRESENCE | ○ | 14 | 7 |
| 11 | K | 0.89 | 750 | 15 | 24 | PRESENCE | PRESENCE | ○ | 11 | 5 |
| 12 | L | 0.91 | 750 | 15 | 26 | PRESENCE | PRESENCE | ○ | 0 | 1 |
| 13 | M | 0.89 | 750 | 15 | 25 | PRESENCE | PRESENCE | ○ | 12 | 5 |
| 14 | N | 0.95 | 750 | 15 | 28 | PRESENCE | PRESENCE | ○ | 0 | 0 |
| 15 | O | 0.50 | 530 | 10 | 0 | ABSENCE | ABSENCE | X | 0 | 0 |
| 16 | P | 0.50 | 550 | 10 | 5 | PRESENCE | PRESENCE | ○ | 24 | 8 |
| 17 | Q | 0.50 | 600 | 10 | 15 | PRESENCE | PRESENCE | ○ | 32 | 8 |
| 18 | R | 0.50 | 750 | 10 | 24 | PRESENCE | PRESENCE | ○ | 22 | 8 |
| 19 | S | 0.50 | 800 | 10 | 29 | PRESENCE | PRESENCE | ○ | 21 | 7 |
| 20 | T | 0.50 | 820 | 10 | 35 | PRESENCE | PRESENCE | ○ | 24 | 7 |
| 21 | U | 0.75 | 710 | 8 | 19 | PRESENCE | PRESENCE | ○ | 11 | 3 |
| 22 | V | 0.75 | 710 | 10 | 21 | PRESENCE | PRESENCE | ○ | 12 | 3 |
| 23 | W | 0.75 | 710 | 12 | 20 | PRESENCE | PRESENCE | ○ | 10 | 5 |
| 24 | X | 0.75 | 710 | 15 | 20 | PRESENCE | PRESENCE | ○ | 13 | 6 |
| 25 | Y | 0.75 | 710 | 20 | 21 | PRESENCE | PRESENCE | ○ | 12 | 4 |
| 26 | Z | 0.75 | 710 | 25 | 23 | PRESENCE | PRESENCE | ○ | 10 | 4 |

| STEEL SHEET No. | x IN $(Fe_x, Mn_{1-x})_2SiO_4$ BECOMES SMALL TOWARD INWARD SIDE | AMORPHOUS $SiO_2$ | NET-LIKE STRUCTURE IN RANGE OF 0 TO 50% OF THICKNESS OF INTERNAL OXIDE LAYER FROM INTERFACE BETWEEN INTERNAL OXIDE LAYER AND BASE IRON | EVALUATION TEST 1 PICKLING FINISH TIME/ SECOND | EVALUATION TEST 2 SURFACE PROPERTY AFTER COLD ROLLING | REMARKS |
|---|---|---|---|---|---|---|
| 1 | ○ | PRESENCE | ○ | 45 | OUT OF TARGET OF EVALUATION | COMPARATIVE EXAMPLE |
| 2 | ○ | PRESENCE | ○ | 45 | ○ | EXAMPLE |
| 3 | ○ | PRESENCE | ○ | 50 | ○ | EXAMPLE |

TABLE 2-continued

| | | | | | | |
|---|---|---|---|---|---|---|
| 4 | ○ | PRESENCE | ○ | 55 | ○ | EXAMPLE |
| 5 | Δ | PRESENCE | Δ | 95 | ○ | EXAMPLE |
| 6 | Δ | PRESENCE | Δ | 115 | ○ | EXAMPLE |
| 7 | X | PRESENCE | X | 170 | X | COMPARATIVE EXAMPLE |
| 8 | ○ | PRESENCE | Δ | 60 | ○ | EXAMPLE |
| 9 | ○ | PRESENCE | Δ | 60 | ○ | EXAMPLE |
| 10 | Δ | PRESENCE | Δ | 100 | ○ | EXAMPLE |
| 11 | Δ | PRESENCE | Δ | 120 | ○ | EXAMPLE |
| 12 | X | PRESENCE | X | 180 | X | COMPARATIVE EXAMPLE |
| 13 | Δ | PRESENCE | Δ | 120 | ○ | EXAMPLE |
| 14 | X | PRESENCE | X | 200 | X | COMPARATIVE EXAMPLE |
| 15 | X | ABSENCE | X | 45 | OUT OF TARGET OF EVALUATION | COMPARATIVE EXAMPLE |
| 16 | Δ | PRESENCE | Δ | 60 | ○ | EXAMPLE |
| 17 | ○ | PRESENCE | Δ | 60 | ○ | EXAMPLE |
| 18 | Δ | PRESENCE | Δ | 85 | ○ | EXAMPLE |
| 19 | Δ | PRESENCE | Δ | 95 | ○ | EXAMPLE |
| 20 | Δ | PRESENCE | X | 155 | X | COMPARATIVE EXAMPLE |
| 21 | Δ | PRESENCE | X | 155 | X | COMPARATIVE EXAMPLE |
| 22 | Δ | PRESENCE | Δ | 110 | ○ | EXAMPLE |
| 23 | Δ | PRESENCE | Δ | 110 | ○ | EXAMPLE |
| 24 | Δ | PRESENCE | Δ | 95 | ○ | EXAMPLE |
| 25 | Δ | PRESENCE | Δ | 105 | ○ | EXAMPLE |
| 26 | Δ | PRESENCE | Δ | 130 | OUT OF TARGET OF EVALUATION | COMPARATIVE EXAMPLE |

<Evaluation Test 1 Pickling Finish Time>

The steel sheets No. 1 to No. 7 in Table 2 are examples when they were common in a point that each thereof contained 1.0 mass % of Si, set the coiling temperature to 650° C., set the retention time in the temperature range from 400° C. to 500° C. to 15 hours, and changed the Si/Mn ratio.

In the steel sheets No. 2 to No. 4, the Si/Mn ratio was not less than 0.27 nor more than 0.70, and in this case, the pickling finish time became from 45 seconds to 55 seconds. Since the Si/Mn ratio was low to be 0.70 or less as described above, the Mn proportion increased toward the inward side, and at the interface between the internal oxide layer and the base iron, there was generated the $(Fe_x, Mn_{1-x})_2SiO_4$ with x close to 0. Further, since the retention time in the temperature range from 400° C. to 500° C. was 15 hours, the net-like oxide was generated in a wide area of about 50% or more of the outward side of the internal oxide layer. Consequently, the number of branches of the internal oxide in the crystal grain in the internal oxide layer was increased, resulting in that the number of connections of the internal oxides of the crystal grain boundary and inside of the crystal grain was increased. From the above results, it was possible to obtain a result that in the steel sheets No. 2 to No. 4, the pickling solution easily permeated from the crystal grain boundary through the interface between the oxide and the metallic parent phase set as a dissolving path.

Further, in the steel sheets No. 5 and No. 6, the Si/Mn ratio was greater than 0.70 and equal to or less than 0.90, and in this case, the pickling finish time became from 95 seconds to 115 seconds. It can be considered that this result was obtained because the activity of Mn reduced more when compared to the case where the Si/Mn ratio was 0.70 or less, and thus formation of the net-like oxide was reduced.

On the other hand, the steel sheet No. 1 had the Si/Mn ratio of less than 0.27, and in this case, the pickling finish time was short to be 45 seconds. In the steel sheet No. 1, the Mn content was excessively high, so that embrittlement and deterioration of weldability were recognized, and thus the steel sheet did not fulfill the properties as the high-strength steel. Further, the steel sheet No. 7 had the Si/Mn ratio of greater than 0.90, and in this case, the pickling finish time became 170 seconds. In the steel sheet No. 7, since the activity of Mn was small, the branch of the internal oxide in the crystal grain was not recognized, and thus the generation of $(Fe_x, Mn_{1-x})_2SiO_4$ ($0 \leq x < 1$) containing Mn in the crystal grain was not confirmed almost at all. Further, it can be considered that the dissolution was hard to progress in the steel sheet No. 7, since the structure of the net-like oxide was not generated.

The steel sheets No. 8 to No. 12 were common in a point that each thereof contained Si of 2.0 mass %, and the steel sheets No. 13 and No. 14 were common in a point that each thereof contained Si of 3.0 mass %. Further, the steel sheets No. 8 to No. 14 are examples when they set the coiling temperature to 750° C., set the retention time in the temperature range from 400° C. to 500° C. to 15 hours, and changed the Si/Mn ratio.

In the steel sheets No. 8 and No. 9, the Si/Mn ratio was not less than 0.27 nor more than 0.70, and a large number of branches of the internal oxide in the crystal grain in the internal oxide layer and a large number of connections of the internal oxides of the crystal grain boundary and inside of the crystal grain, were confirmed. However, since the coiling temperature was high to be 750° C., the internal oxide layer also became thick. Further, a proportion of generation area of the net-like oxide structure in the sheet thickness direction of the internal oxide layer became lower than that of the steel sheets No. 2 to No. 4, and thus the pickling finish time of each of the steel sheets No. 8 and No. 9 was 60 seconds. On the other hand, in the steel sheets No. 10, No. 11, and No. 13, the Si/Mn ratio was greater than 0.70 and equal to or less than 0.90, and the pickling finish time was from 100 seconds to 120 seconds.

Further, in the steel sheets No. 12 and No. 14, the Si/Mn ratio exceeded 0.90, and the pickling finish time of the steel sheets No. 12 and No. 14 became from 180 seconds to 200 seconds. It can be considered that this result was obtained because no branch of the internal oxide in the crystal grain was recognized so that the dissolution in the crystal grain was quite difficult to progress, and in addition to that, the coiling temperature was 750° C. so that the thickness of the internal oxide layer was thick to be 25 μm or more.

The steel sheets No. 15 to No. 20 were common in a point that each thereof had the Si/Mn ratio of 0.50 and the retention time at 400° C. to 500° C. after the coiling of 10 hours, but, they differed in the coiling temperature. From the experimental results of the steel sheets No. 16 to No. 19, when the coiling temperature was from 550° C. to 800° C., there was a tendency that as the coiling temperature increased, the thickness of the internal oxide layer increased, and the pickling finish time of these samples was from 60 seconds to 95 seconds.

On the other hand, the steel sheet No. 15 is a steel sheet manufactured by being subjected to the coiling step at 530° C., and there was obtained a result that no internal oxide layer was formed, and the pickling finish time was short to be 45 seconds. However, in the steel sheet No. 15, the ferrite transformation and the pearlite transformation did not occur, and the strength of the steel sheet was excessively high, so that the steel sheet did not fulfill the strength properties required for the cold rolling. Further, in the steel sheet No. 20, since the coiling temperature was 820° C., the internal oxide layer of 30 μm or more was generated, which was not favorable also from a viewpoint of yield, and the pickling finish time of 155 seconds was required.

The steel sheets No. 21 to No. 26 were common in a point that each thereof had the Si/Mn ratio of 0.75 and the coiling temperature of 710° C., but, they differed in the retention time at 400° C. to 500° C. after the coiling. In the steel sheets No. 24 and No. 25 in which the retention time after the coiling was not less than 15 hours nor more than 20 hours, although the thickness of the internal oxide layer was about 20 μm, the net-like structure in the crystal grain was sufficiently generated, and there was obtained a result that the pickling finish time was short to be from 95 seconds to 105 seconds. Further, in the steel sheets No. 22 and No. 23, the retention time after the coiling was equal to or more than 10 hours and less than 15 hours, the monotonous increase in the proportion of Mn toward the inward direction of the internal oxide layer of $(Fe_x, Mn_{1-x})_2SiO_4$ ($0 \leq x < 1$) was not recognized, and the pickling finish time was 110 seconds.

On the other hand, in the steel sheet No. 21, the retention time after the coiling was less than 10 hours, so that the growth in the crystal grain and in the sheet thickness direction of the net-like structure was insufficient, and the pickling finish time of 155 seconds was required. Further, in the steel sheet No. 26, the retention time after the coiling was more than 20 hours, and in a part of the steel sheet, the net-like structure was recognized in a wide range of 0% to 50% of the thickness of the internal oxide layer from the interface between the internal oxide layer and the base iron toward the direction of the surface layer oxide scale, and the pickling finish time was 130 seconds. However, a nitride and a carbide were significantly generated in the base iron, which caused reduction in ductility and stretch flangeability, so that the steel sheet did not fulfill the requirement as the steel material.

<Evaluation Test 2 Cold Rolling Property of Pickled Material>

Subsequently, in order to check the influence on the cold rolling property, the hot-rolled steel sheets each obtained by being subjected to the pickling treatment for its target pickling time, were subjected to rolling treatment using a cold rolling mill until the sheet thickness reached 1.5 mm, and then the presence/absence of peeling and unevenness on the surface was checked through visual observation. The steel sheet on which the peeling and the unevenness were not recognized, was determined as ○, and the steel sheet on which the peeling and the unevenness were recognized, was determined as ×.

Note that regarding the steel sheet No. 1, it was not possible to perform the cold working due to occurrence of slab cracking and poor weld during the manufacturing step. Further, in the steel sheet No. 26, a nitride and a carbide were generated in the steel material and coarsening thereof occurred, so that the steel sheet did not satisfy the ductility and the stretch flangeability required for the high-strength steel sheet. For this reason, the steel sheets No. 1 and No. 26 were set to be excluded from the target of the present evaluation. Further, in the steel sheet No. 15, the strength of the steel sheet was excessively high, so that it was not possible to perform the cold rolling until the steel sheet had the predetermined thickness and the test did not reach the check on the surface property after the cold rolling, and thus the steel sheet No. 15 was set to be excluded from the target of the evaluation.

In the steel sheets No. 2 to No. 6, No. 8 to No. 11, No. 13, No. 16 to No. 19, and No. 22 to No. 25 in Table 2, even if each of them was subjected to the pickling and then the cold rolling, no abnormality of the surface property was recognized. On the other hand, in the steel sheets No. 7, No. 12, No. 14, No. 20, and No. 21, even if each of them was subjected to the pickling and then the cold rolling, an abnormality such as peeling, an unevenness, a non-covered area, or the like, was recognized in a part of the cold-rolled steel sheet. It can be considered that this result was obtained because there existed a part in which the crystal grain of the internal oxide layer failed to be completely dissolved and removed by each targeted pickling time remained on the base iron, and the performance of cold rolling led to the surface abnormality. From the above results, the steel sheets capable of reducing the pickling time while maintaining the properties of the cold rolling, were steel sheets No. 2 to No. 6, No. 8 to No. 11, No. 13, No. 16 to No. 19, and No. 22 to No. 25.

INDUSTRIAL APPLICABILITY

According to the present invention, it is possible to reduce a pickling time of a steel sheet obtained by performing hot rolling and then coiling on a steel sheet having high contents of Si and Mn, and productivity of a cold-rolled steel sheet is greatly improved while maintaining properties similar to those of a conventional cold-rolled steel sheet.

The invention claimed is:

1. A hot-rolled steel sheet, comprising:

C: 0.05 mass % to 0.45 mass %;

Si: 0.5 mass % to 3.0 mass %;

Mn: 0.50 mass % to 3.60 mass %;

P: 0.030 mass % or less;

S: 0.010 mass % or less;

Al: 0 mass % to 1.5 mass %;

N: 0.010 mass % or less;

O: 0.010 mass % or less;

Ti: 0 mass % to 0.150 mass %;

Nb: 0 mass % to 0.150 mass %;

V: 0 mass % to 0.150 mass %;

B: 0 mass % to 0.010 mass %;

Mo: 0 mass % to 1.00 mass %;

W: 0 mass % to 1.00 mass %;

Cr: 0 mass % to 2.00 mass %;

Ni: 0 mass % to 2.00 mass %;

Cu: 0 mass % to 2.00 mass %;

a total of one kind or two kinds or more selected from a group consisting of Ca, Ce, Zr, Hf, and REM: 0 mass % to 0.500 mass %; and the balance: iron and impurities, wherein:

a Si/Mn ratio of steel material components of a base material of the steel sheet is not less than 0.27 nor more than 0.90 in mass ratio;

an internal oxide layer having a thickness of not less than 1 um nor more than 30 um is provided right below an oxide scale of a steel sheet surface layer portion; and an internal oxide in a crystal grain existing in a region of greater than 0% and 30% or less of a thickness of the internal oxide layer from an interface between the internal oxide layer and base iron toward the surface layer oxide scale:

contains Si and has a thickness of not less than 10 mu nor more than 200 nm; and forms a net-like structure in which one or more branches of the internal oxide exist in any 1 μm×1 μm square region of a cross section and an internal oxide at any crystal grain boundary with a length of 1 μm is connected to one or more of the internal oxides, and wherein the net-like structure is formed in a manner that e internal oxides are dispersed in substantially the entire area in the crystal grain.

2. The hot-rolled steel sheet according to claim 1, wherein the Si/Mn ratio of the steel material components of the base material is 0.70 or less in mass ratio.

3. The hot-rolled steel sheet according to claim 1, wherein in the internal oxide layer, an oxide $(Fe_x, Mn_{1-x})_2SiO_4$ ($0 \leq x < 1$) whose x value decreases toward a center of the steel sheet, and an amorphous $SiO_2$ exist.

4. The hot-rolled steel sheet according to claim 2, wherein in the internal oxide layer, an oxide $(Fe_x, Mn_{1-x})_2SiO_4$ ($0 \leq x < 1$) whose x value decreases toward a center of the steel sheet, and an amorphous $SiO_2$ exist.

5. The hot-rolled steel sheet according to claim 1, wherein in the internal oxide layer, the oxide containing Si and having the net-like structure exists in a range of greater than 0% and 50% or less of the thickness of the internal oxide layer from the interface between the internal oxide layer and the base iron toward the direction of the surface layer oxide scale.

6. The hot-rolled steel sheet according to claim 2, wherein in the internal oxide layer, the oxide containing Si and having the net-like structure exists in a range of greater than 0% and 50% or less of the thickness of the internal oxide layer from the interface between the internal oxide layer and the base iron toward the direction of the surface layer oxide scale.

7. The hot-rolled steel sheet according to claim 3, wherein in the internal oxide layer, the oxide containing Si and having the net-like structure exists in a range of greater than 0% and 50% or less of the thickness of the internal oxide layer from the interface between the internal oxide layer and the base iron toward the direction of the surface layer oxide scale.

8. The hot-rolled steel sheet according to claim 4, wherein in the internal oxide layer, the oxide containing Si and having the net-like structure exists in a range of greater than 0% and 50% or less of the thickness of the internal oxide layer from the interface between the internal oxide layer and the base iron toward the direction of the surface layer oxide scale.

* * * * *